US009770922B2

(12) United States Patent
Cofler

(10) Patent No.: US 9,770,922 B2
(45) Date of Patent: Sep. 26, 2017

(54) PRINTING SYSTEM AND METHOD

(71) Applicant: Velox-PureDigital Ltd., Kfar Yona (IL)

(72) Inventor: Marian Cofler, Kfar Yona (IL)

(73) Assignee: VELOX-PUREDIGITAL LTD., Kfar Yona (IL)

( * ) Notice: Subject to any disclaimer, the term of this patent is extended or adjusted under 35 U.S.C. 154(b) by 0 days.

(21) Appl. No.: 14/443,312

(22) PCT Filed: Nov. 14, 2013

(86) PCT No.: PCT/IL2013/050946

§ 371 (c)(1),
(2) Date: May 15, 2015

(87) PCT Pub. No.: WO2014/076704

PCT Pub. Date: May 22, 2014

(65) Prior Publication Data

US 2015/0298467 A1 Oct. 22, 2015

Related U.S. Application Data

(60) Provisional application No. 61/726,859, filed on Nov. 15, 2012.

(51) Int. Cl.
*B41J 11/00* (2006.01)
*B41J 3/407* (2006.01)
(Continued)

(52) U.S. Cl.
CPC ..... *B41J 11/007* (2013.01); *B41F 17/006* (2013.01); *B41F 17/20* (2013.01); *B41F 19/007* (2013.01); *B41J 3/4073* (2013.01)

(58) Field of Classification Search
CPC ..... B41J 11/007; B41J 3/4073; B41F 17/006; B41F 19/007; B41F 17/20
See application file for complete search history.

(56) References Cited

U.S. PATENT DOCUMENTS 3,933,091 A 1/1976 Von Saspe
4,263,846 A 4/1981 Eldred et al.
(Continued)

FOREIGN PATENT DOCUMENTS

CN 101190593 A 6/2008
EP 0209896 A2 1/1987
(Continued)

OTHER PUBLICATIONS

International Search Report and Written Opinion for Application No. PCT/IL2013/050946 dated Feb. 3, 2014.
(Continued)

*Primary Examiner* — Justin Seo
(74) *Attorney, Agent, or Firm* — FisherBroyles, LLP; Robert Kinberg

(57) ABSTRACT

A printing technique is presented for efficiently printing (i.e. with production lines rates at high resolution and high accuracy) on outer surfaces of a plurality of objects passing in an optimized stream through a printing route/zone. According to this technique, at least one array of printing head units is provided being configured to define at least one printing route along a printing axis, where the at least one printing route is a substantially linear segment of a closed loop lane along which the objects are progressing.

28 Claims, 19 Drawing Sheets

(51) Int. Cl.

| | |
|---|---|
| ***B41F 17/00*** | (2006.01) |
| ***B41F 17/20*** | (2006.01) |
| ***B41F 19/00*** | (2006.01) |

(56) References Cited

U.S. PATENT DOCUMENTS

| | | | | |
|---|---|---|---|---|
| 5,594,044 | A | 1/1997 | Yang | |
| 6,135,654 | A | 10/2000 | Jennel | |
| 6,357,868 | B1 | 3/2002 | Pfaff et al. | |
| 6,397,740 | B1 | 6/2002 | Dubuit | |
| 6,769,357 | B1 * | 8/2004 | Finan | B41J 3/4073 101/38.1 |
| 7,231,873 | B2 | 6/2007 | Macchi | |
| 7,467,847 | B2 | 12/2008 | Baxter et al. | |
| 7,506,942 | B2 | 3/2009 | Martinez | |
| 7,819,055 | B2 | 10/2010 | Tezuka et al. | |
| 7,971,527 | B2 | 7/2011 | Bausenwein et al. | |
| 8,109,611 | B2 | 2/2012 | Silverbrook | |
| 2001/0042456 | A1 | 11/2001 | Kamen et al. | |
| 2006/0018698 | A1 | 1/2006 | Vogt | |
| 2006/0250464 | A1 | 11/2006 | Sheinman | |
| 2007/0283648 | A1 | 12/2007 | Chen | |
| 2009/0213157 | A1 | 8/2009 | Obertegger et al. | |
| 2010/0038339 | A1 | 2/2010 | Uptergrove | |
| 2010/0096386 | A1 | 4/2010 | Uptergrove et al. | |
| 2010/0192517 | A1 | 8/2010 | Schach | |
| 2010/0200451 | A1 | 8/2010 | Uptergrove | |
| 2010/0259575 | A1 | 10/2010 | Uptergrove | |
| 2010/0259587 | A1 | 10/2010 | Uptergrove | |
| 2010/0295885 | A1 | 11/2010 | LaCaze | |
| 2010/0302304 | A1 | 12/2010 | Bauer | |
| 2012/0098914 | A1 | 4/2012 | Dubuit et al. | |

FOREIGN PATENT DOCUMENTS

| | | | |
|---|---|---|---|
| EP | 2179853 | A1 | 4/2010 |
| JP | 2010-535112 | A | 11/2010 |
| JP | 2012-527387 | A | 11/2012 |
| WO | 2004/009360 | A1 | 1/2004 |
| WO | 2011/154628 | A1 | 12/2011 |

OTHER PUBLICATIONS

Supplementary European Search Report for Application No. EP13855428 dated Sep. 2, 2015.

Chinese Office Action, dated Feb. 4, 2017, for corresponding CN Application No. 201380070539.8.

Japanese Office Action, dated Jun. 27, 2017, for corresponding JP Application No. 2015-542410.

* cited by examiner

200

PRINTING SYSTEM AND METHOD

CROSS-REFERENCE TO RELATED APPLICATIONS

The present application is a national phase entry under 35 U.S.C. §371 of International Application No. PCT/IL2013/050946, filed Nov. 14, 2013, published in English, which claims priority from U.S. Provisional Patent Application No. 61/726,859, filed Nov. 15, 2012, all of which are incorporated herein by reference.

TECHNOLOGICAL FIELD

The invention is generally in the field of digital printing and relates to printing system and method, in particular for printing on a curved surface.

BACKGROUND

Digital printing is a printing technique commonly used in the printing industry, as it allows for on-demand printing, short turn-around, and even a modification of the image (variable data) with each impression. Some of the techniques developed for printing on a surface of a three-dimensional object are described hereinbelow.

U.S. Pat. No. 7,467,847 relates to a printing apparatus adapted for printing on a printing surface of a three-dimensional object. The apparatus comprises an inkjet printhead having a plurality of nozzles, and being operative to effect relative movement of the printhead and the object, during printing, with a rotational component about an axis of rotation and with a linear component, in which the linear component is at least partially in a direction substantially parallel with the axis of rotation and wherein the nozzle pitch of the printhead is greater than the grid pitch to be printed onto the printing surface in the nozzle row direction.

U.S. Pat. No. 6,769,357 relates to a digitally controlled can printing apparatus for printing on circular two-piece cans, the apparatus including digital print-heads for printing an image on the cans and drives for transporting and rotating the cans in front of the print-heads in registered alignment.

US Patent Application No. 2010/0295885 describes an ink jet printer for printing on a cylindrical object using printheads positioned above a line of travel and a carriage assembly configured to hold the object axially aligned along the line of travel and to position the object relative to the printheads, and rotate it relative to the printheads. A curing device located along the line of travel is used to emit energy suitable to cure the deposited fluid.

GENERAL DESCRIPTION

There is a need in the art for printing techniques that allow expediting the printing process while enabling maximal utilization (high efficiency) of the printing technology by allowing simultaneous printing on a plurality of objects. It is also required that such printing techniques retain a relatively high printing resolution, with very high system accuracies (microns), which makes inkjet printing technology very challenging for real production line use. Therefore, maintaining a high efficiency level by maximizing the printing engine utilization is necessary in such techniques to perform production runs.

In the above-mentioned patent publications (U.S. Pat. No. 7,467,847 and U.S. Pat. No. 6,769,357), printing takes place at discrete printing stations and is interrupted while the object is transported between printing stations. This interruption significantly slows the printing process. The inventor of the present invention has developed novel printing techniques enabling conducting a fast and efficient printing process on curved (and/or flat) surfaces of a plurality of objects streamed into the printing system from a production line.

The present invention is aimed at expediting the printing process, by providing a print head assembly which includes a plurality of print head units, where the print head units are arranged in a corresponding plurality of different (e.g., spaced-apart) locations along an axis of translation. In particular, in some embodiments a closed loop lane is used in the printing system to manage at least one stream of objects from a production line and move the stream of object over the lane through one or more stages of the printing process. A printing zone is defined along a section of the closed loop lane wherein a printing assembly is operatively installed for printing on external surfaces of the objects traversing the printing zone by at least one array of print head units of the print head assembly.

The at least one array of print head units is preferably configured to define at least one printing route along a printing axis for advancing the stream of objects therealong while printing over their external surfaces by the print head units of the assembly. The print head assembly may comprise several arrays of print head units, each configured to define at least one printing route along the printing axis and which may be used for passing additional streams of objects therealong for printing on the objects. For example, and without being limiting, each print head array may comprise one or more aligned columns of print head units, wherein the print head units in each column have a predefined slant defining a specific orientation of each column of print head units to thereby direct their printing elements (e.g., printing nozzles for ejecting a material composition, markers, engraving tools, laser markers, paint markers) towards a specific printing path covered by the array.

The lane may comprise a conveyor system configured to convey the stream of objects along the lane and pass the objects through one or more zones of the lane adapted for carrying out various functionalities of the system. One or more support platforms (also referred to herein as carriages) may be used in the conveyor system to translate the stream of objects over the lane. In some embodiments each support platform is configured to be loaded with at least one stream of objects from the production line and slide the objects over the lane through its one or more zones for processing and treatment. The support platform may be configured to maintain a stream of objects loaded thereto and aligned with respect to one or more printing routes defined by the print head assembly, and controllably rotate the objects carried by the platform whenever passing through certain zones of the lane (e.g., the printing zone).

The lane may include loading and unloading zones configured to receive one or more such streams of objects, and for removing the objects therefrom after completing the printing (typically requiring a single loop travel over the lane). A priming zone may be also defined on a section of the lane, typically upstream to the loading zone, wherein the surface areas of the loaded objects undergo a pre-treatment process designed to prepare the surface areas of the objects for the printing process. The lane may further comprise a curing zone, typically upstream to the printing zone, wherein the objects exiting the printing zone undergo a curing process (e.g., ultra violet—UV) to cure material compositions applied to their external surfaces.

In some embodiments, projections of the print head units on the axis of translations fall on different portions of the axis of translation. In this setup, the conveyor system effects a relative motion between the objects and the print head units. The relative motion provides both (i) a rotational motion around the axis of translation for bringing desired regions of the object's surface to the vicinity of the desired print head units and (ii) a translational motion along the axis of translation needed for bringing the object from one of print head units to a successive print head unit. This enables two or more print head units to print on the same object simultaneously. In the techniques of the present application the objects may be printed upon while being moved between groups of print head units. In this manner, the printing process is accelerated, and high printing throughput can be achieved. Additionally, the configuration of the printing system simultaneously prints on more than one object at the same time, by exposing consecutive objects to the arrays of print head units. It is further noted that the array of print head units is suitable for printing also on long objects at a variety of diameters.

The printing may be performed continuously (continuous printing) or in discrete steps (step printing). If the printing is continuous, the relative motion between object and print head units includes concurrent translation along the axis of translation and rotation around the axis of translation. In this manner printing of image data on the object's surface occurs along a substantially spiral path. If the printing occurs in discrete steps, a relative translation between the object and the print heads brings desired regions of the object in the vicinity of one or more groups. The translation is stopped, and a relative rotation is effected, in order to enable circumferential printing on the object's surface.

In some embodiments the print head assembly includes a plurality of groups of printing heads. Each group includes at least two print head units arranged in different locations along a curved path around said axis of translation and surrounding a respective region of the axis of translation.

Therefore, an aspect of some embodiments of the present application relates to a printing system configured for printing on an outer curved surface of a volumetric object. The system comprises a conveyor system and a print head assembly. The conveyor system is configured for effecting a relative translation between the object and the print head assembly along an axis of translation, and for effecting a relative rotation between the object and the print head assembly around the axis of translation. The print head assembly comprises a plurality of print head units, arranged such that projections of different print head units on the axis of translations fall on different portions of the axis of translation, each of the print head units having at least one nozzle and/or ejection aperture (also referred to herein as printing element) for ejecting a material composition onto the object's surface.

In a variant, the print head assembly further comprises additional print head units, such that the print head units are arranged in a plurality of groups, at least one group comprising at least two of the print head units arranged along a curved path around the axis of translation, and each group surrounding a respective region of the axis of translation.

In another variant, the printing system comprises a control unit configured to operate the conveyor system to carry out said translation and rotation and to operate at least some of the print head units according to a predetermined pattern.

The control unit may be configured to operate the conveyor system and at least some of the print head units, so as to effect simultaneous printing of image data on the object's surface by at least two print head units, each belonging to a respective one of the groups.

Optionally, the control unit is configured to operate the conveyor system and at least some of the print head units, so as to effect simultaneous printing of image data on the object's surface by different printing elements of a single one of the print head units.

The control unit may be configured to operate the conveyor system and at least some of the print head units, so as to effect simultaneous printing of image data on the object's surface by at least two print head units belonging to a single one of the groups.

In a variant, the conveyor system is configured for moving the object along the axis of translation. In another variant, the conveyor system is configured for moving the print head assembly along the axis of translation. In yet another variant, the conveyor system is configured for rotating the object around the axis of translation. In a further variant, the conveyor system is configured for rotating the print head assembly around the axis of translation.

In some embodiments the control unit is configured to operate the conveyor system to carry out the translation in a step-like fashion and to carry out the rotation at least during a time interval in which translation does not occur, and to operate at least some of the print head units to carry out the printing during the time interval in which translation does not occur and rotation occurs.

In some embodiments the control unit is configured for operating the conveyor system to carry out the translation and rotation simultaneously while operating at least some of the print head units to effect printing, such that continuous printing of image data is performed on the object's surface along at least one substantially spiral path.

In a variant, said conveyor system is further configured for effecting a relative motion between the object and the print head assembly along one or more radial axes substantially perpendicular to the axis of translation, in order to maintain a desired distance between at least one print head unit and the object's surface, while said at least one print head unit prints data on said surface.

In another variant, the conveyor system is configured for displacing at least one of the print head units to move towards and away from the translation axis.

In yet another variant, the conveyor system is configured and operable for displacing said at least one of said print head units with respect to the translation axis before operating the print head assembly to print the image data.

In a further variant, the conveyor system is configured and operable for displacing said at least one of the print head units with respect to the translation axis during the printing of the image data.

In yet a further variant, the conveyor system is configured and operable to operate said displacement to adjust a position of said at least one print head unit to conform to a shape of the surface of the object which is to undergo said printing.

In some embodiments of the present invention, the control unit is configured to operate said displacement of said at least one print head unit between an inoperative passive position and an operative active position of said at least one print head unit.

In a variant, the print head units of the same group are configured for ejecting a material composition of the same color. In another variant, each of the groups of print head units is configured for ejecting a material composition of a respective color.

In yet another variant, the printing system comprises at least one curing unit configured for curing a material composition ejected by any print head unit on the object's outer surface, the curing unit being located downstream along the translation axis of a last one of said print head units.

In a further variant, the printing system comprises at least one priming unit configured for priming at least one location of the object's surface to receive a composition to be ejected by at least one of the print head units, the priming unit being located upstream along the translation axis of a last one of said print head units. In yet a further variant, the printing system comprises at least a second curing unit located between print head units belonging to the same group. Optionally, the printing system comprises at least a second priming unit located between print head units belonging to the same group.

In a variant, projections along the translation axis of the print head units of at least one group fall on a single region of the translation axis. In another variant, the print head units of at least one of the groups are staggered, such that projections along the translation axis of at least two of the print head units of the at least one group fall on a different regions of the translation axis. In yet another variant, different print head units are configured for ejecting respective material composition on a region of the object's surface, such that a combination of the respective compositions on the object's surface forms a desired composition.

In a further variant, successive printing elements (e.g., nozzles and/or ejection apertures) of at least one of the print head units are configured for ejecting respective compositions on a region of the object's surface, such that a combination of the respective compositions on the object's surface forms a desired composition.

Optionally, the combination of the respective compositions comprises at least one of a mixing between the respective compositions and a chemical reaction between the respective compositions.

In yet another aspect there is provided a printing system for printing on outer surfaces of objects progressing on a production line. The system may comprise one or more print head assemblies comprising an array of print head units configured to define at least one printing route along a printing axis, the print head units being arranged in a spaced-apart relationship along the at least one printing route, each of the print head units having at least one printing element (e.g., comprising at least one of a nozzle for ejecting a material composition, a marker, an engraving tool, a laser marker, and a paint marker) for printing onto respective portions of the objects successively aligned with the at least one printing element while moving with respect to the print head assembly. A conveyor system is used for moving at least one stream of objects in a successive manner along a general conveying direction through said at least one printing route, the conveyor system comprising a closed loop lane, said at least one printing route being a substantially linear segment of said closed loop lane.

The system may comprise a support platform for supporting the at least one stream of objects respectively. The support platform is mountable on the conveyor system for moving the objects along the general conveying direction passing through the at least one printing route and configured to effect rotation of the objects about the printing axis while moving along the printing route.

In a possible embodiment the print head assembly comprises at least one additional array of the print head units, such that the printing units of the at least one additional print head array are arranged along at least one additional printing route along the printing axis, and at least two of the printing units in each one of the at least two arrays being spaced-apart along an axis traverse to the printing axis. Accordingly, the support platform may be configured to support at least one additional stream of objects and to move them on the conveyor system along the general conveying direction passing through the at least one additional printing route. For example, and without being limiting, the print head units of the at least two arrays may be arranged in a common plane such that each array of the print head units define a respective printing route, where the conveyor system and the support platform are configured for simultaneously moving the at least two streams of objects along the at least two printing routes covered by the respective at least two arrays of the printing head units.

In some embodiments a control unit is used to operate the conveyor system to carry out the translational movement along the general conveying direction, to operate the support platform to carry out the rotational movement, and to operate at least some of the print head units to concurrently print on the objects of the at least one stream of objects. The control unit may be configured to operate the support platform to carry out the rotational movement.

In some embodiments the control unit is configured to operate the conveyor system to carry out the translational movement along the general conveying direction in a step-like fashion, and to operate the support platform to carry out the rotation at least during a time interval in which translational movement does not occur, and to operate at least some of the print head units to carry out the printing during the time interval in which translation does not occur and rotation occurs.

Optionally, the control unit may be configured for operating the conveyor system and the support platform to carry out the translation and rotation simultaneously while operating at least some of the print head units to effect printing, such that substantially continuous printing of image data is performed on the surfaces of the objects in the stream of objects along a spiral path.

In a variant, the control unit is configured to operate the conveyor system and at least some of the print head units, so as to effect simultaneous printing of image data on surfaces of the objects by at least two print head units belonging to different arrays of print head units.

In some embodiments the control unit is configured and operable to effect a change in a distance between at least one print head unit and the object surface aligned with the at least one print head unit to thereby adjust a position of the at least one print head unit to conform to a shape of the surface of the object.

In a possible embodiment the print head units may be mounted for movement along radial axes or one or more axes substantially perpendicular to the printing axis.

Optionally, the control unit is configured to selectively shift one or more of the print head units between an inoperative passive state and an operative active state thereof, and between different operative states thereof.

In some possible embodiments the control unit is configured to generate a virtual signal for synchronizing operation of the printing elements according to angular and linear positions of the objects carried by the support platform along the printing route. More particularly, the virtual signal is used to synchronize the location of the carriages and the angular position of the objects carried by the carriages in the printing zone and operate the printing heads to apply a predetermined pattern to the surfaces of the objects after adjusting the location of the carriages and the angular orientation of the objects according to the virtual signal.

In yet another aspect there is provided a method of printing on outer surfaces of objects from a production line, the method comprising passing at least one stream of said objects through a printing route comprising at least one array of printing head units arranged along a printing axis, receiving data indicative of locations of the stream of objects passing through the printing route and of angular orientation of each object in the stream, determining, based on the received data, surface areas of the objects facing the print head units of the at least one array, and one or more printing patterns to be applied on the surface areas by the respective print head units, and operating the array of print head units to apply the one or more patterns on the surface area by the respective printing head units.

The method may comprise rotating the objects passing through the printing route during application of the one or more patterns. Optionally, the stream of objects are advanced along the at least one printing route during application of the one or more patterns. In some embodiments a pre-treatment process is applied to surface areas of the stream objects before passing them through the printing route. A curing process may be also applied to surface areas of the stream of objects before passing them through the printing route.

The method may further comprise generating a virtual signal for synchronizing operation of the printing head units according to angular and linear positions of the objects progressing through the printing route.

BRIEF DESCRIPTION OF THE DRAWINGS

In order to better understand the subject matter that is disclosed herein and to exemplify how it may be carried out in practice, embodiments will now be described, by way of non-limiting example only, with reference to the accompanying drawings, in which.

DETAILED DESCRIPTION OF EMBODIMENTS

Figure 1:
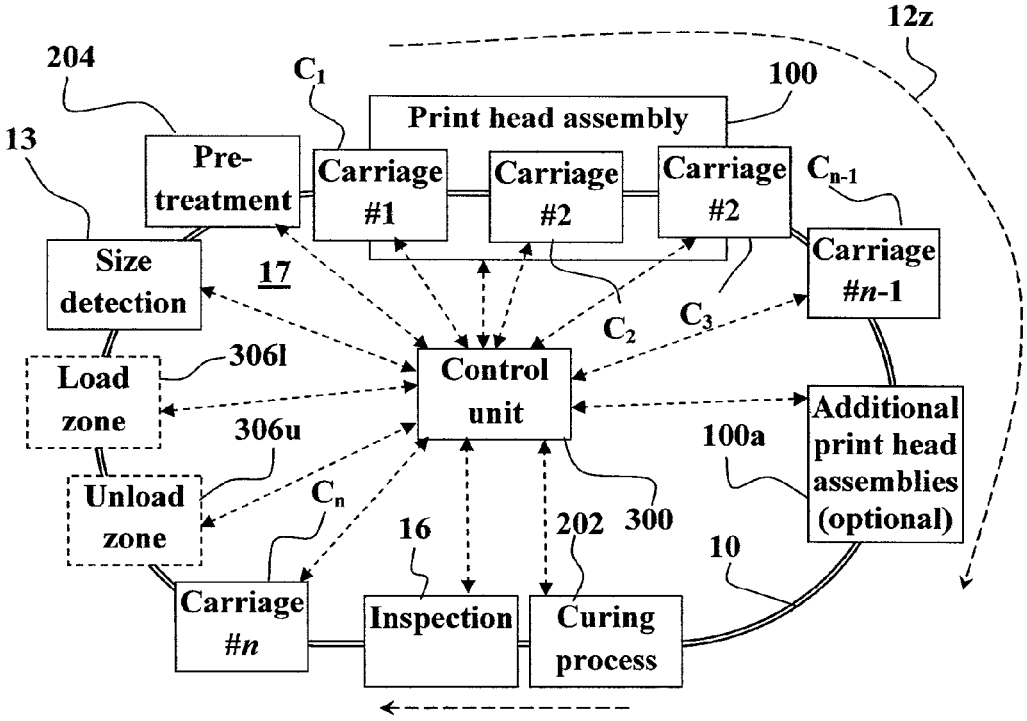
FIG. 1 schematically illustrates a printing system according to some possible embodiments employing a closed loop lane to translate objects therealong.

The various embodiments of the present invention are described below with reference to FIGS. 1 through 20 of the drawings, which are to be considered in all aspects as illustrative only and not restrictive in any manner Elements illustrated in the drawings are not necessarily to scale, emphasis instead being placed upon clearly illustrating the principles of the invention. This invention may be provided in other specific forms and embodiments without departing from the essential characteristics described herein.

FIG. 1 schematically illustrates a printing system 17 according to some possible embodiments employing a closed loop lane 10 (e.g., elliptical track) to translate objects to be printed on (not shown) therealong towards a printing zone 12*z* provided in the lane 10 and comprising one or more printing head assemblies 100 (e.g., comprising printing heads of various colors). The printing system 17 in this non-limiting example comprises a loading zone 306*l* configured for automatic loading of a plurality of objects to be printed on, from a production line. The loading zone 306*l* may comprise a loading unit employing an independent controller and one or more sensors, motors mechanics and pneumatics elements, and being configured to communicate measured sensor data with a control unit 300 of the printing system 17 for timing, monitoring and managing the loading process. In some embodiments, the loading unit is configured to load a stream of objects to the system's lane at the same accurate index (used for marking printing start point on the surface of the object e.g., in cases in which the object has a previous mark or cap orientation).

In some embodiments the loaded objects are attached to a plurality of carriages $C_1$, $C_2$, $C_3$, . . . , $C_{n-1}$, $C_n$ (also referred to herein as support platforms or as carriages $C_i$) configured for successive movement over the lane 10 and for communicating data with the control unit 300 regarding operational state of the carriages $C_i$ (e.g., speed, position, errors etc.). As described hereinbelow in detail, the carriages $C_i$ may be configured to simultaneously, or intermittently, or in an independently controlled manner, move the carriages $C_i$ along the lane 10, and to simultaneously, or intermittently, or in an independently controlled manner, to move and rotate the object attached to them (e.g., using rotatable mandrels, not shown in FIG. 1) while being treated in a pre-treatment unit 204 (also referred to herein as a priming station) and/or being treated/coated/primed prior, during or after, printing on in the printing zone 12*z*.

A size detection unit 13 may be used in the lane 10 to determine sizes (geometrical dimensions and shapes) of the objects received at the loading zone 306*l* and to communicate size data to the control unit 300. The size data received from the size detection unit 13 is processed and analyzed by the control unit 300 and used by it to adjust positions of print head units of the print head assembly 100 and alert on any possible collision scenarios.

A pre-treatment unit 204 may be also provided in the lane 10 to apply a pre-treatment process to the surfaces of the objects moved along the lane 10 (e.g., plasma, corona and/or flame treatment to improve adhesion of the ink to the container and create uniformity of the surface to the introduced printing/coating). Accordingly, control unit 300 may be configured to adjust operation of the pre-treatment unit 204 according to size data received from the size detection unit 13. As exemplified in FIG. 1 the print head assembly 100 may be configured to accommodate a plurality of carriages $C_i$ (in this example three carriages $C_1$, $C_2$ and $C_3$ are shown) and simultaneously print on surfaces of the objects attached to each one of the carriages.

Objects exiting the printing zone 12*z* may be moved along a portion of the lane comprising a curing unit 202. The curing unit 202 may be operated by the control unit 300 and configured to finalize the printing process by curing the one or more layer of compositions applied to their surfaces (e.g., employing an ultra-violet/UV ink curing process or any other fixing or drying process such as IR, Electronic beam, chemical reaction, and suchlike). A vision inspection unit 16 may be further used to collect data (e.g., image data) indicative of the colors, patterns (e.g., print registration, diagnostics, missing nozzles, image completeness) applied to the objects exiting the printing zone 12*z* and/or the curing unit 202. After the printing, and optionally curing and/or inspection, process is completed the objects may be advanced over the lane 10 towards an unloading zone 306*u* for automatic removal thereof from the printing system 17. The unloading zone 306*u* may include an unloading unit employing an independent controller and one or more sensor units, motors, mechanics and pneumatics elements, and being configured to communicate sensor data with the control unit 300 of the printing system 17 for monitoring and managing the unloading process.

Figure 2A:
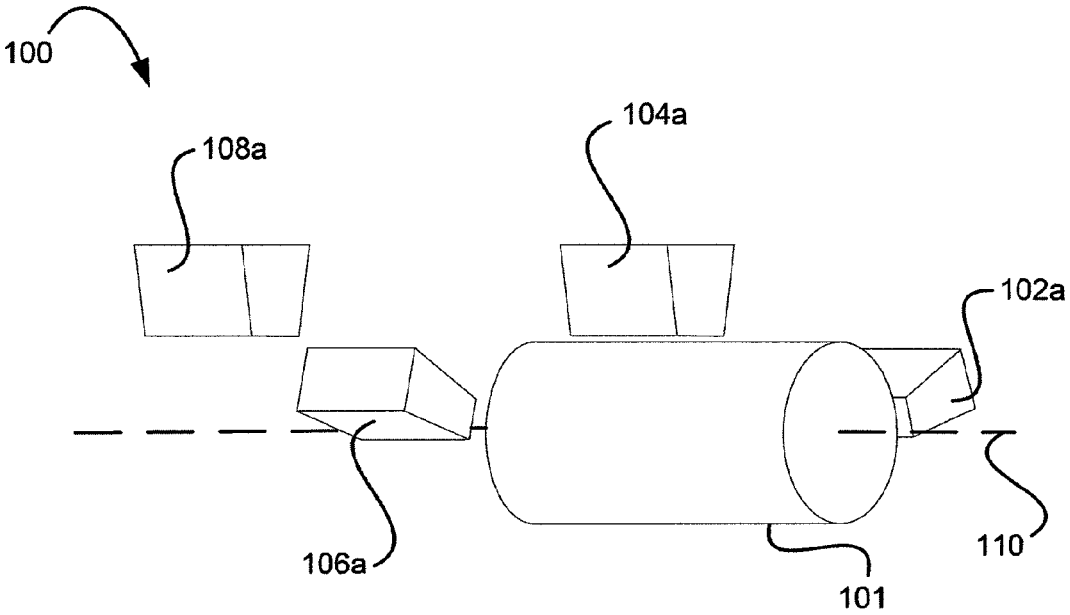
FIGS. 2A and 2B are schematic drawings illustrating different examples of a print head assembly according to some embodiments, which includes a plurality of print head units located at successive positions along an axis of translation.
Figure 2B:
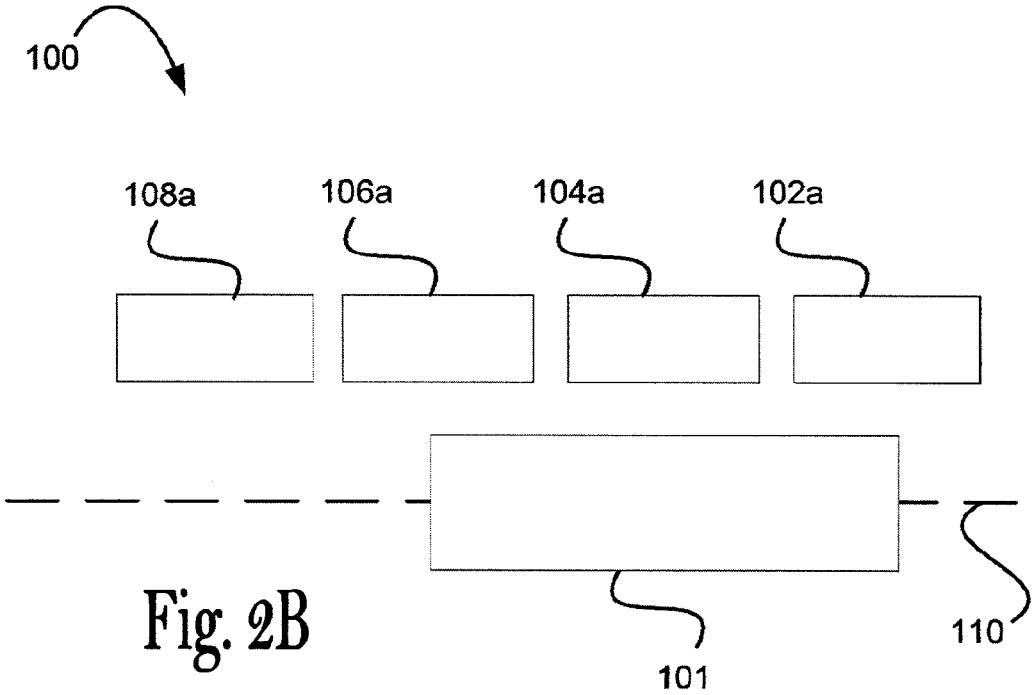

FIGS. 2A and 2B are schematic drawings illustrating different examples of a print head assembly 100 of the present disclosure, which includes a plurality of print head units located at successive positions along an axis of translation.

In the example of FIG. 2A, the print head units 102*a*, 104*a*, 106*a*, 108*a* are arranged such that projections of different print head units on the axis of translation fall on different portions of the axis of translation 110 (along the printing axis), and are set at respective (angular) locations around the axis of translation 100. In the example of FIG. 2B, the print head units 102*a*, 104*a*, 106*a*, 108*a* are arranged such that projections of different print head units on the axis of translations fall on different portions of the axis of translation 110, and are positioned at the same (angular) locations around the axis of translation 110, to form a line of print head units substantially parallel to the axis of translation 110.

In this non-limiting example the axis of translation 110 generally corresponds to an axis of the object 101, and is the axis along which a respective translation between the object 101 and the print head assembly 100 may occur. Moreover, a relative rotation between the object 101 and the print head assembly 100 may occur around the axis of translation 100. The details of the translational and rotational motions will be discussed later hereinbelow.

Figure 3A:
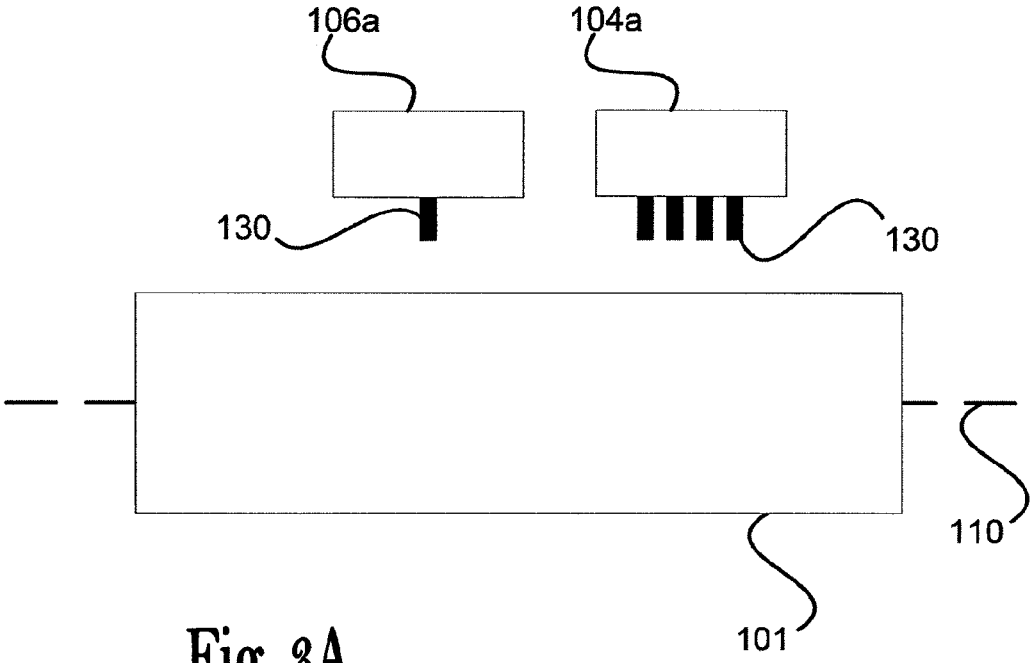
FIGS. 3A and 3B are schematic drawings illustrating possible arrangements of printing elements on single print head units, according to some possible embodiments.
Figure 3B:
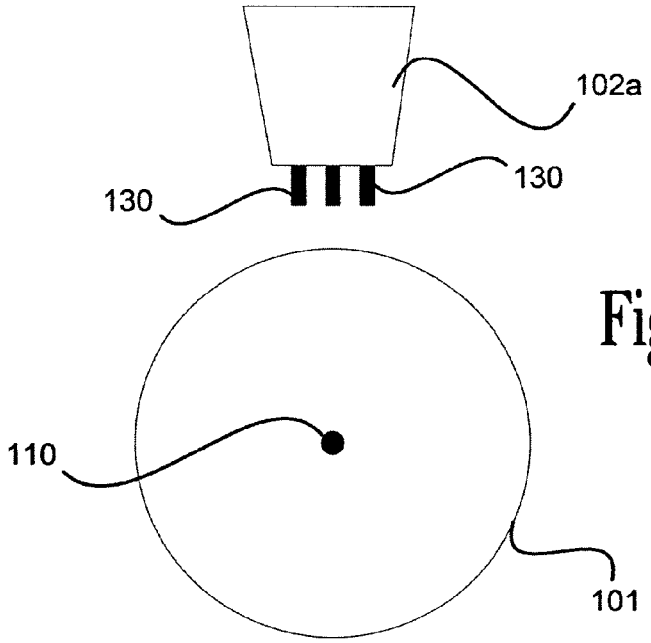

Referring now to FIGS. 3A and 3B, schematically illustrating possible arrangements of printing elements 130 (e.g., nozzles or ejection apertures) on single print head units, according to some possible embodiments.

As exemplified in FIGS. 3A/B, a print head unit may include one or more nozzles or ejection apertures (generally 130) configured for enabling ejection of material compositions onto the surface of the object 101. The material compositions may be fluids (as is the case in inkjet printing, and plastic jetting or/and printing) and/or solids (e.g., powders, as is the case in laser printing). The term printing is herein meant to include any type of ejection of a material onto a surface of an object, and/or engraving or marking dots, lines or patterns thereon. Thus printing includes, for example, changing the color, the shape, or the texture of an object, by ejecting a material on the object's surface, engraving and/or applying marks thereon. For example, and without being limiting, the printing head units may comprise one or more markers (e.g., engraving tool, laser marker, paint marker, and suchlike) configured to apply visible and/or invisible (i.e., functional, such as electronic charges) markings on the external surfaces of the objects traversing the printing zone 12*z*.

FIG. 3A exemplifies different configurations of printing elements 130 of the print head units 104*a* and 106*a*. The print head units 104*a* and 106*a* are shown from a side thereof parallel to the translation axis. The print head unit 104*a* includes a plurality of printing elements 130 (e.g., four), set along a row at successive locations along the axis of translation. The print head unit 106*a* in this non-limiting example includes a single printing element 130, as commonly used in the art for jetting plastic compositions.

FIG. 3B exemplifies a possible configuration of the printing elements provided in the print head unit 102*a*. FIG. 3B shows a front view of the print head unit 102*a* (perpendicular to the translation axis 110). In this non-limiting example, the print head unit 102*a* includes a column of printing elements 130 set in a line perpendicular to the translation axis 110. Optionally, not all of the printing elements 130 are perpendicular to the object's surface. In the example of FIG. 3B, the printing element is perpendicular to the object's surface, e.g., is configured for ejecting a material composition along an ejection path perpendicular to the object's surface. On the other hand, the outer printing elements located on the sides of the central printing element are oblique to the object's surface.

Figure 4A:
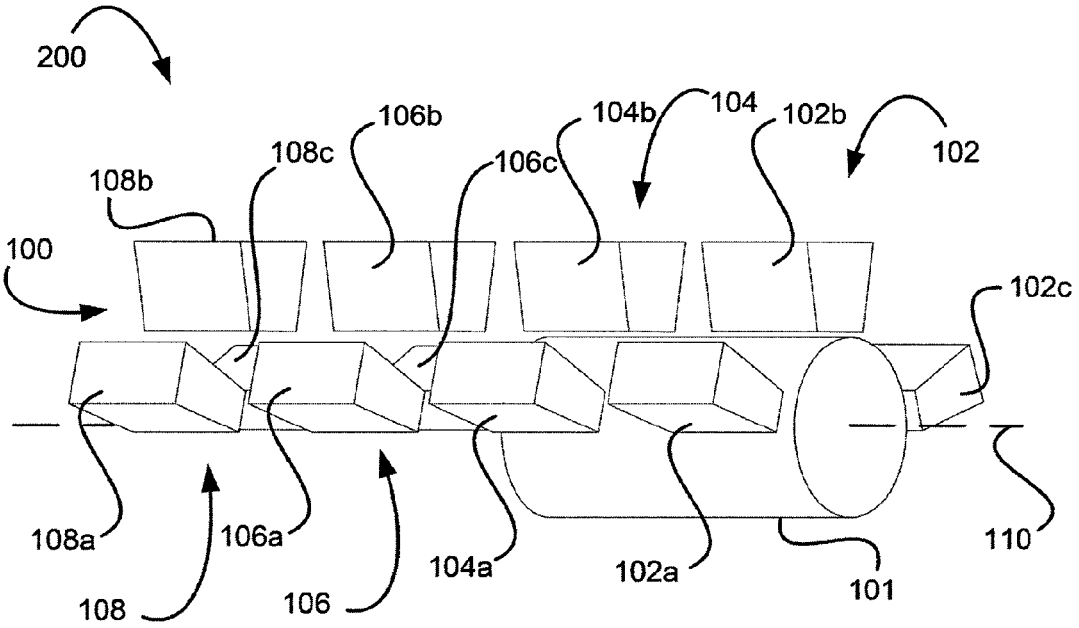
FIGS. 4A and 4B are schematic drawings illustrating different views of the printing array according to some possible embodiments, which includes a plurality of groups of print head units located at successive positions along an axis of translation.
Figure 4B:
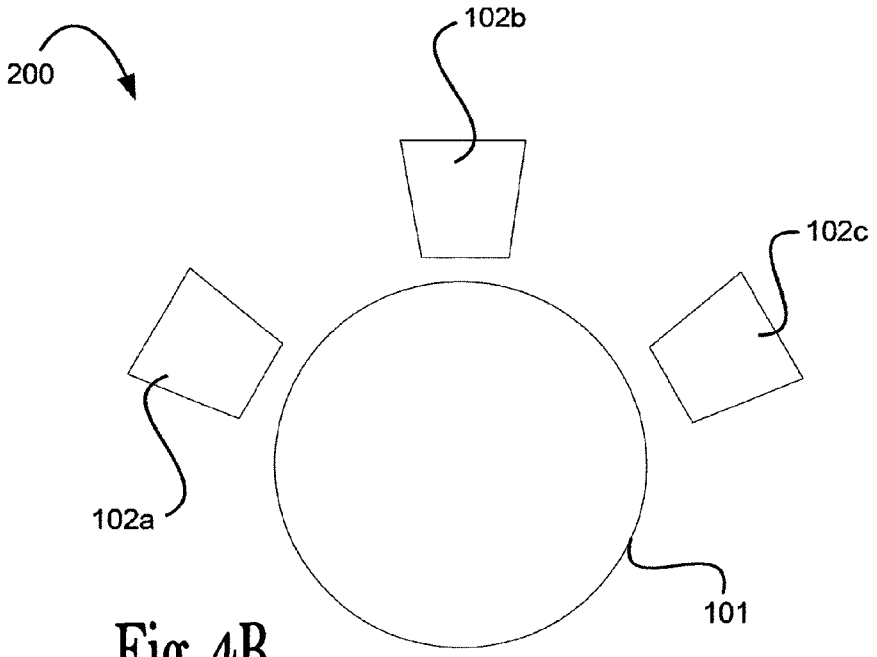

Optionally, a print head unit used in the present invention can include a plurality of rows or columns of printing elements forming a two dimensional array defining a surface of the print head assembly facing the object. The print head assembly may be configured in any shape, such as, but not limited to, rectangular, parallelogram, or the like. Referring now to FIGS. 4A and 4B, schematically illustrating different views of a printing system 200 of the present disclosure. In FIG. 4A, a perspective view is shown, while in FIG. 4B, a front view is shown. The printing system 200 is configured for printing an image/pattern on a curved outer surface of the object 101, and includes a print head assembly 100 having a plurality of print head units, and a conveyor system (302 in FIGS. 5A and 15) configured for moving the object 101 and/or the print head units. Optionally, the system 200 includes a control unit (300, shown in FIGS. 1 and 21A) configured for controlling the conveyor system 302 and the operation of the print head units. The curved surface of the object may be circular, oval, elliptical, etc.

In some embodiments, each print head unit includes one or more printing elements e.g., configured for jetting/applying a material composition (such as ink, powder, curing fluid, fixation fluid, pretreatment fluid, coating fluid, and/or a composition of one or more fluids to create a third fluid, and/or any solid/gas material that, while jetted, is a fluid) onto the outer surface of the object 101, as described above. The print head assembly 100 may be designed as the print head assemblies described in FIGS. 2A and 2B, or as a print head assembly 100 in which the print head units are organized in groups, as will be now described.

In the example shown in FIGS. 4A and 4B, the print head units of each group are arranged along a curved path around the axis of translation, and each group surrounds a respective region of the axis of translation 110. Thus, the print head units 102*a*, 102*b*, and 102*c* belong to a first group 102. The print head units 104*a*, 104*b*, and 104*c* (seen in FIG. 13) belong to a second group 104. The print head units 106*a*, 106*b*, and 106*c* belong to a third group 106. The print head units 108*a*, 108*b*, and 108*c* belong to a fourth group 108. The groups 102, 104 and 106 are located at respective locations along the axis of translation.

The conveyor system 302 is configured to move the object 101 and/or the print head assembly 100 such that a desired portion of the object 101 is brought to the vicinity of a desired print head unit at a desired time. In this manner, printing can be performed on the object's outer surface. The conveyor is configured for enabling at least two kinds of relative motion between the object 101 and the print head assembly: (i) a translational motion along or parallel to the axis of translation 110, and (ii) a rotation about the axis of translation 110. In this manner, any point on the outer surface of the object 101 can be brought to the vicinity of any print head unit. Optionally, a third kind of relative motion exists along one or more radial (or planar) axes substantially perpendicular to the axis of translation. This third motion may be necessary, in order to maintain a desired distance between at least one print head unit and the object's surface.

In some embodiments the control unit (300) is an electronic unit configured to transmit, or transfer from a motion encoder of the carriage, one or more signals to the print head units in the assembly 100 and to the conveyor system 302. Alternatively, the signals from the motion encoder are transferred directly to the print head assembly wherein they are translated by each print head unit into printing instructions based on signals received from the control unit 300. Accordingly, the positional control signal(s) transmitted from one of the carriage's encoders to the print head assembly 100, may be used by the control unit (300) to instruct individual print head units to eject their respective material compositions from one or more printing elements (e.g., nozzles/ejection apertures) at specific times. The control unit 300 further generated control signal(s) to the conveyor system 302, to instruct the conveyor system 302 to move (i.e., translate and/or rotate) the objects 101 and/or the print head assembly 100 according to a desired pattern. The control unit 300 therefore synchronizes the operation of the print head units with the relative motion between the object 101 and the print head assembly 100, in order to create a desired printing pattern on the object and therefore print a desired image on the object's outer surface.

The groups of print head units are set along the translation axis 110, such that during the relative motion between the object 101 and the print head assembly 100, the object 101 is successively brought in the vicinity of different print head units or groups of print head units. Moreover, during at least certain stages of this motion, different portions of the objects 101 may be located in the vicinity of print head units belonging to at least two consecutive groups or print head units located at successive positions along the axis of translation 110. In this manner, the object's outer surface may be printed upon simultaneously by print head units belonging to different groups or print head units located at successive positions along the axis of translation 110.

Optionally, different printing elements of a single printing unit may print on two different objects at the same time. As explained above, this feature enables the system 200 to perform printing on one or more objects while optimizing the utilization of print heads, thereby achieving a high efficiency system capable of providing high objects throughput. As exemplified in FIG. 4A, during a certain time period, the object 101 is in the vicinity of the first group (which includes print head units 102*a*, 102*b*, and 102*c*) and the second group (which includes print head units 104*a*, 104*b*, and 104*c*).

Besides enhancing the printing throughput on one or more objects, the structure of the system 200 also enables simultaneous printing on a plurality of objects 101. For this purpose, the objects 101 are fed into the system 200 one after the other, and the conveyor system 302 moves (i.e., translates and/or rotates) the objects 101 and/or the assembly 100 of print head units, so that each object 101 can be printed upon by certain portions of the print head units which are not printing on another object. For example, in FIG. 4A, the object 101 is in the vicinity of the first and second group (though in practice, an object can be printed upon by more than two groups if the object is long enough compared to the print heads and to the distances between print heads along the axis of translation). If no other object is present, the print head units of the third group (106*a*, 106*b*, and 106*c*) and the print head units of the fourth group (108*a*, 108*b*, and 108*c*) are idle. However, if a second object is introduced into the system 200 and moved to the vicinity of the printing heads of the first and/or second group, the first object will be moved to the vicinity of the second and/or third groups. In this manner, at least some of latter (second and third) groups of the printing heads will be able to print an image on the first object and the former (first and second) groups of the print head units will be able to print an image on the second object.

The printing system is considered fully utilized when under all the print heads units there are objects that are being printed on by the print heads units. To this end, any gap between the objects in the printing zone is considered as decreasing the efficiency, and therefore it is required that gaps between objects be minimized.

As can be seen in FIG. 4B, the print head units of each group are set around the translation axis 110, so as to maintain a desired distance from the object's outer surface. The print head units may be set in a spaced apart arrangement, or may be adjacent to each other. The distances between consecutive print head units belonging to the same group may be equal to each other or different to each other. Moreover, within a group, the print head units may be set around the object's outer surface, such that the distances between the different print head units and the object's outer surface are equal to each other, or such that each print head unit has a respective distance from the object's outer surface. The distance between the print head units and the object's outer surface depends on the type of print head units used and composition, and is chosen so that the print head units deliver their compositions in a desired fashion. It should be noticed that the composition jetted by the print head units may be a chemical material, a chemical compound of materials and/or a mixture between materials and/or compounds.

In some embodiments of the present invention, the printing on the object's surface by different print head units or by different printing elements 130 of a print head unit may be performed for the purpose of creating a new path that was not printed beforehand. Optionally, some of the printing may be performed along or near an existing printed path. A path printed near or between two other paths may be used to achieve a predefined resolution. A path printed along an existing path may be used to complete the resolution of the existing path by adding more dots to create a denser spiral path. Moreover, printing a path along an existing path may be used to create redundancy between two different printing elements, i.e., if one printing element is not working then the second printing element prints a portion (e.g., 50%) of the desired data. Optionally, in case one of the printing element stops operating, the system can be controlled so as to enable the second printing element to print the data that was originally intended to be printed by the first printing element. This may be done, for example, by controlling (e.g., slowing) down the motion (translation and/or rotation) of the object 101 and/or print head array, or by controlling the second printing element to jet more ink Optionally, the print head units belonging to the same group are configured for jetting ink of a single color to the object's surface, and the different groups of print head units are configured for jetting respective colors to the object's surface. Alternatively, different print head units belonging to the same group are configured for jetting ink of different colors.

It should be noted that although in the above-mentioned figures each group is shown to include three print head units, the groups may have any number of printing units, for example, one, two, four, etc. Moreover, though the above-mentioned figures show the presence of four groups, any number of groups may be included in the system of the present invention. Additionally, the print head units in the above-mentioned figures are shown to be shorter than the length of the object 101. This may not be the case, as in some cases, the print head units may be as long as the object, or even longer.

The system 200 can be used to print on the object 101 according to two different printing sequences: continuous printing and step printing or any combination thereof. In continuous printing, the printing occurs during the relative motion between the object 101 and the print head arrangement 100, when such motion includes simultaneous translational motion along or parallel to the axis of translation 110 and a rotational motion around the axis of translation 110. In this kind of printing, image data is printed on the object's surface along a substantially spiral path.

In step printing, a relative translation between the object and the print heads brings desired regions of the object's surface to the vicinity of one or more print head groups or print head units located at successive positions along the axis of translation. The translation is stopped, while the relative rotation is effected. During the rotation, the print head units perform circumferential printing on the object's surface. After the printing is performed, the relative translation re-starts to bring one or more additional desired regions of the object's surface to the vicinity of one or more print head groups. The rotation may be maintained during the translation, or be discontinued at least during part of the translation.

The steps may be small steps, where translation occurs for moving a desired region of the object 101 from one printing element 130 to a consecutive printing element 130 of a single print head unit, or may be larger steps, where translation occurs for moving a desired region of the object from a first print head unit to a successive print head unit (e.g., belonging to a different group) along the axis of translation 110. In some embodiments, the steps may be large enough to translate a desired region of the object 101 from a first print head unit to a second print head unit while skipping one or more intermediate print head units.

In step printing, the circumferential printing may be activated by a trigger which confirms that the desired region of the object 101 has been translated by a desired distance. This trigger may be a positioning encoder signal and/or an index signal, which is active during translation and non active when no translation occurs. Knowing the speed of translation and the position (along the axis of translation) of the desired print head units and its printing elements 130, the time point at which the desired region of the object 101 is exposed to the desired print head unit, and its printing element 130 can be calculated. Thus, when the trigger is activated by the positioning encoder and/or index signal, an instruction to effect printing is sent to the desired print head unit, and/or printing element 130 for example, according to the encoder position signals. Alternatively, the trigger may be activated by a light detector located on one side of the object 101 and corresponding light emitters located on a second side of the object 101. When the object 101 obscures the light detector, and the light from the light emitter does not reach the light detector, it is deemed that the desired region of the object's surface has been translated by the desired amount.

Optionally, a circumferential coordinate of a certain region of the object's surface is monitored (e.g., calculated via a known speed of rotation and the known radius of the object), and a second trigger is activated when the region reaches a desired circumferential coordinate which corresponds to the circumferential coordinate of desired print head unit, or printing element 130. In a variant, after translation is stopped, the relative rotation is performed to expose the desired region on the object's surface to the desired print head unit, or printing element 130, and only then printing (ejection of the material composition) is effected. In another variant, the second trigger is not used, and when translation ceases, the desired region of the object's surface is exposed to a different print head unit, or printing element 130. Because the circumferential coordinate of desired region is known, the control unit can instruct the different print head unit or printing element 130, to affect a desired printing onto the desired region. This last variant is useful for decreasing delays in the object's printing. A possible printing pattern may include both continuous printing and step printing, performed at different times.

It should be noted that the axis of translation 110 is shown in the figures as a straight line. This may not necessarily be the case. In fact, the axis of translation may be curvilinear, or may have straight sections and curvilinear sections.

Figure 5A:
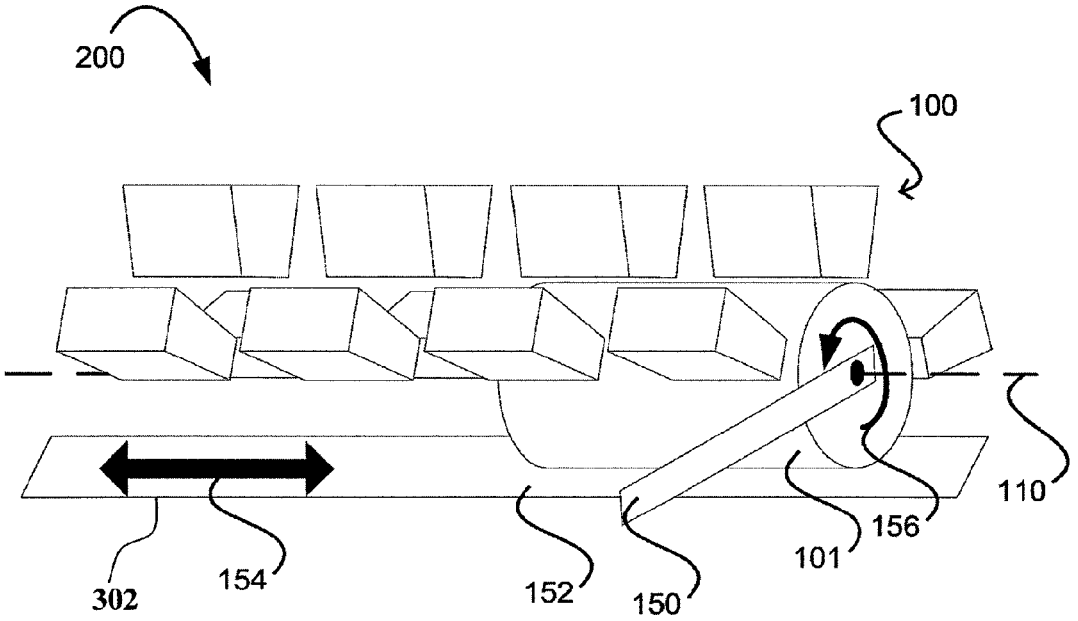
FIGS. 5A and 5B are schematic drawings exemplifying use of a conveyor system according to some possible embodiments.
Figure 5B:
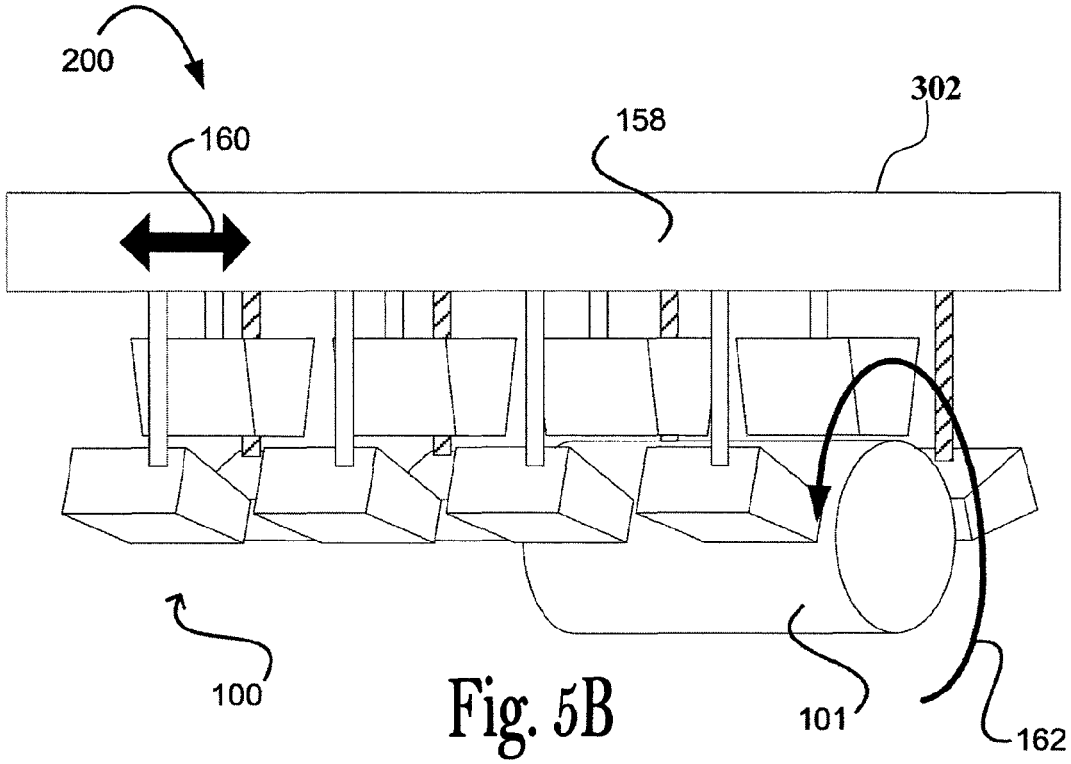

Referring now to FIGS. 5A and 5B, which exemplify a conveyor system 302 included in the printing system in some embodiments. In the non-limiting example illustrated in FIG. 5A the conveyor system 302 is configured to move the object 101, while in FIG. 5B the conveyor system 302 is configured to move the assembly of print heads 100.

In the non-limiting example shown in FIG. 5A, the conveyor system 302 of the system 200 includes an object holder 150 joined to an end of the object 101. In a variant, the object holder moves the object 101 along the translation axis 110, and rotates the object around the translation axis 110. The translation and rotation may or may not be simultaneous, depending on the desired manner of printing. Optionally, the conveyor system 302 includes a conveyor belt 152, which is configured to move the object 101 along the translation axis 110 (as shown by the double arrow 154), while the object holder's function is limited to rotating the object 101 (as shown by the arrow 156).

The conveyor belt 152 may be a belt that is moved by a motion system, such as an electrical motor, linear motor system, multiple linear motor systems that combine to form a route, a magnetic linear system, or an air pressure flow system. In case a plurality of objects is handled, each of the objects may be handled separately by one or more object holders. It may be the case that at different places along the translation axis 110 each of the objects 101 is controlled to translate in a different manner (e.g., at a different speed) along the translation axis 110.

In the non-limiting example shown in FIG. 5B, the conveyor system 302 of the system 200 includes a carriage 158. The carriage 158 in this example carries the print head assembly 100 along a direction parallel to the translation axis 110 (as shown by the double arrow 160) and rotates with the print head units around the translation axis (as shown by the arrow 162).

It should be added that, although not illustrated in the figures, other scenarios are also possible for giving rise to the relative translational and rotational motion between the object and the print head arrangement. In a first possible scenario, the conveyor system 302 is designed for moving the print head assembly 100 along the axis of translation 110 and includes an object holder for rotating the object around the axis of translation 110. In a second possible scenario, the conveyor system 302 is designed for moving the object 101 along the axis of translation 110 and for rotating the print head arrangement around the axis of translation 110.

In some embodiments both the object 101 and the print head arrangements 100 may be moved.

All the above-described manners of relative motion (fixed print head units and moving object, moving print head units and fixed object, translating the object and rotating the print head arrangement, rotating the object and translating the print head arrangement, moving print head units and moving object) are within the scope of the present invention and equivalent to each other. In order to simplify the description of the invention, in the remaining part of this document the description will relate to the case in which the print head units are fixed and the object 101 is moved (translated and rotated). However, references to the motion of the object 101 should be understood as references to the relative motion between the object 101 and the print head unit arrangements 100.

In both of the cases described above, individual print head units and/or individual groups may be movable along the translation axis 110 with respect to each other. This may be used for manual and/or automatic calibration prior and/or post printing. Optionally, individual print head units and/or groups may be movable around or perpendicularly to the translation axis 110. This may also be used for manual and/or automatic calibration prior and/or post printing.

Figure 6A:
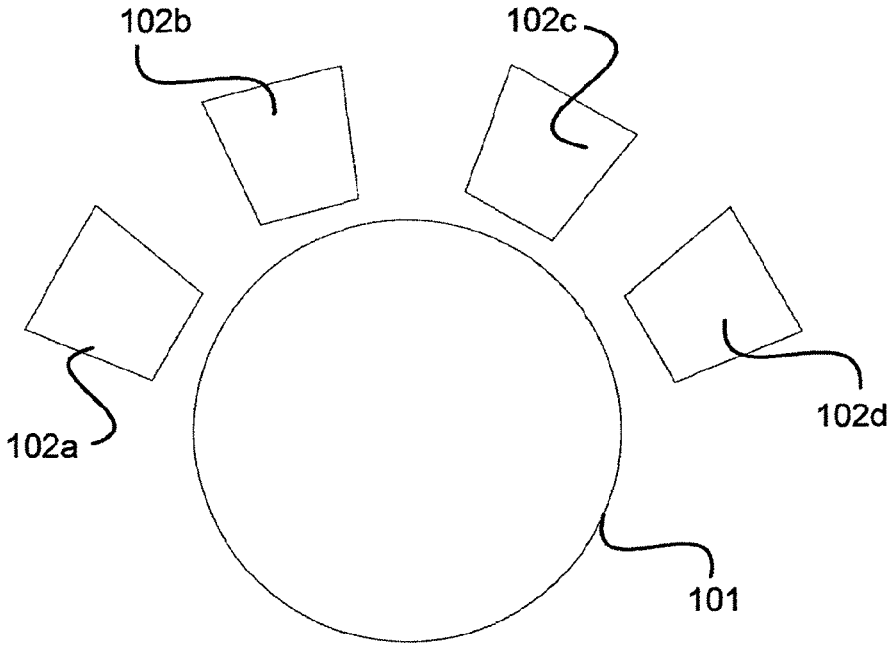
FIGS. 6A and 6B are schematic drawings illustrating some possible embodiments in which the print head units are controllably movable.
Figure 6B:
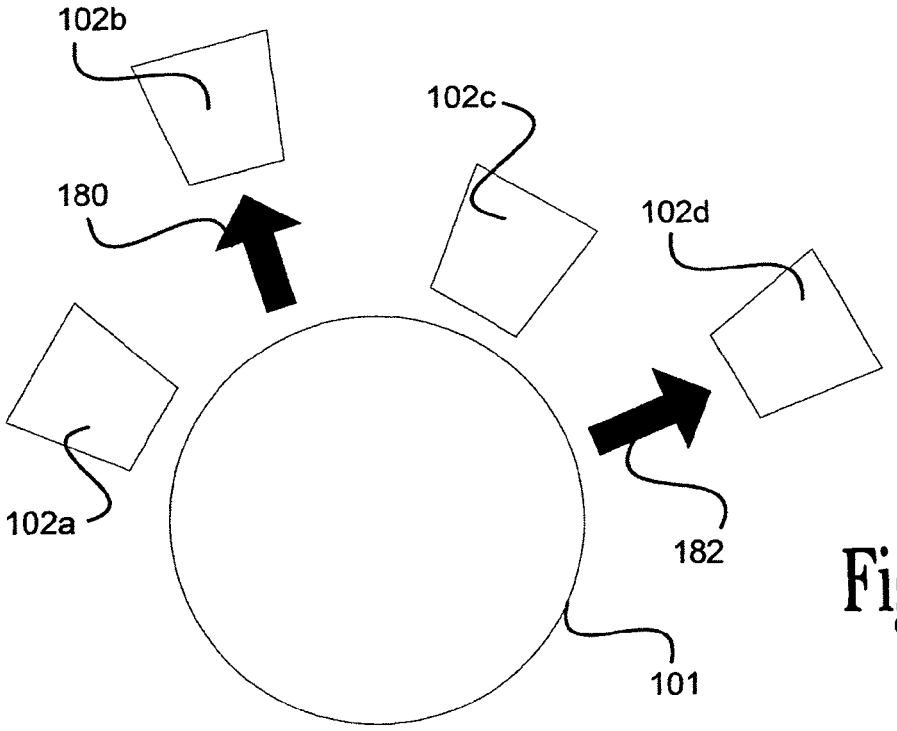

Referring now to FIGS. 6A and 6B, which are schematic drawings illustrating some possible embodiments in which the individual print head units are controllably movable.

In FIG. 6A, the print head units 102*a*-102*d* belong to a single group and are set along the circumference of the object 101. In FIG. 6B, the print head units 102*b* and 102*d* are moved away from the translation axis (or from the object 101), as depicted by the arrows 180 and 182, respectively. In some embodiments of the present invention, at least some print head units can be individually moved toward and away from the object 101. Optionally such motion for each print head unit occurs along a respective axis which is perpendicular to the translation axis. Optionally, the orientation of individual print head units can be adjusted as well.

The ability to move the print head units enables maintaining a desired distance between the print head units and the object 101. Also, the moving of the print head units enables moving the selected print head units between their active positions and their passive positions. This gives flexibility to the print head assembly, as it can be configured in different manners to print on surfaces of different diameters and lengths (e.g., for object of small diameters, the number of active print head units in a group is decreased, to enable the active print heads to be at a desired distance from the object's outer surface). In a variant, the print head units can be moved only prior to the printing, i.e., after the object starts to move the print head units maintain their position with respect to the axis of translation. This feature is advantageous, as it enables the system 200 to keep a desired distance between the print head units and objects having a plurality of diameters and lengths. In another variant, the print head units can be moved during the printing. The latter feature may be advantageous in the instance in which the cross-sectional size and/or shape of the object varies along the length of the object, or in the cases where the object is not circular (as exemplified in FIGS. 7A to 7C).

Figure 7A:
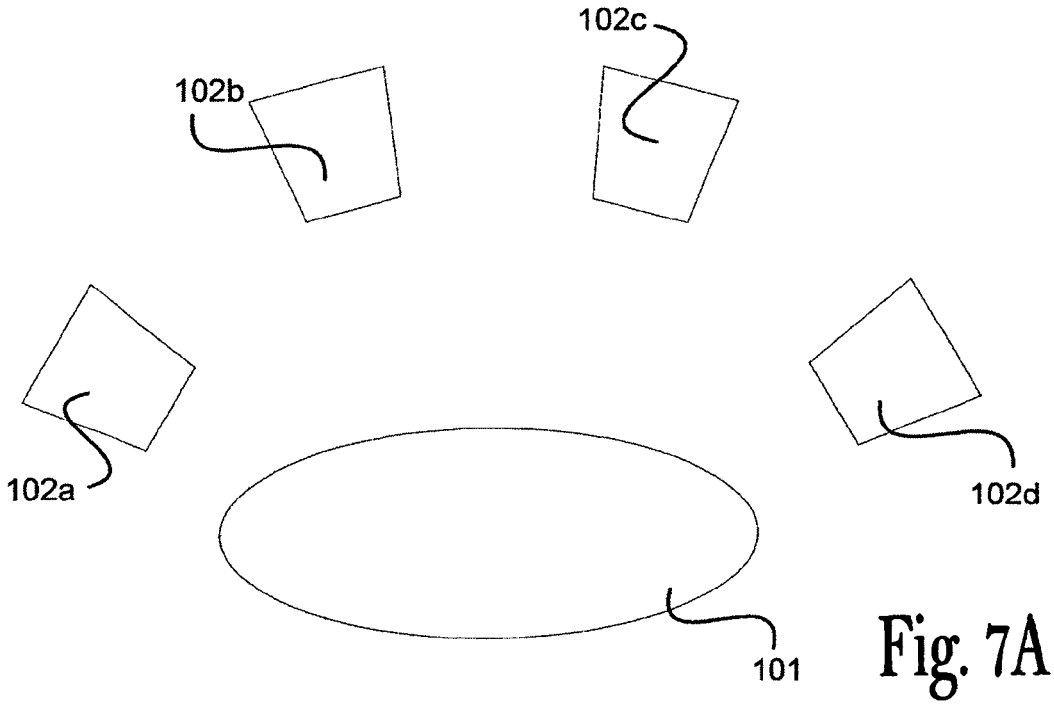
FIGS. 7A and 7B are schematic drawings exemplifying possible embodiments in which the print head units are controllably movable to fit a shape of the object, before and during rotation of the object.
Figure 7B:
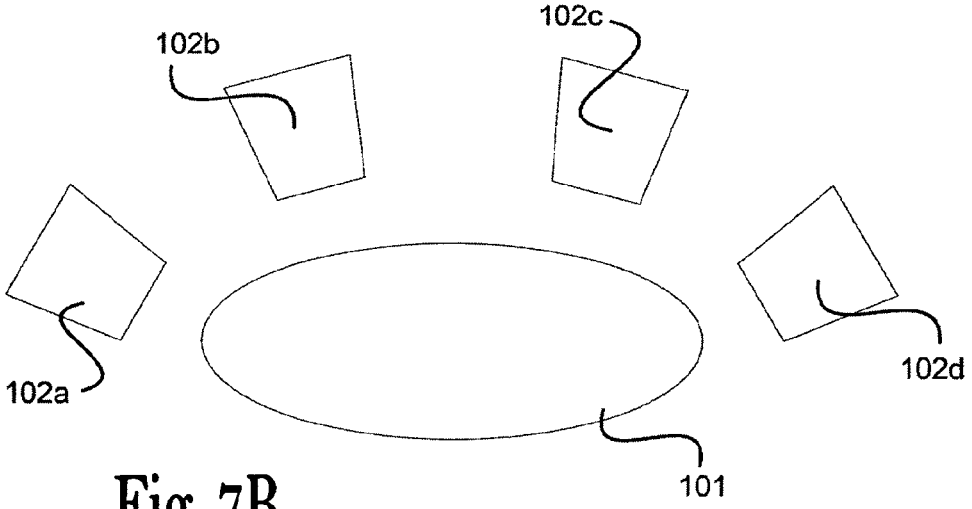

Referring now to FIGS. 7A to 7C, exemplifying embodiments in which the print head units are controllably movable to fit a shape of the object 101, before and during rotation of the object 101.

In FIG. 7A, an object 101 having an elliptical cross section is brought to the system 100. The print head units 102*a*-102*d* belong to a single group and are initially set to match the shape of a circular object. In FIG. 7B, the print head units 102*b* and 102*c* are moved toward the translation axis (located at the center of the elliptical cross section on the object 101 and moving out of the page), so that a desired distance is maintained between the objects' outer surface and each print head unit. The object 101 is rotated. During the rotation, the print head units 102*a*-102*d* are moved with respect to the translation axis, and optionally their orientation is varied. At a certain time, the object 102 has rotated by 90 degrees (see FIG. 6*c*). The print head units 102*a* and 102*d* have been moved toward to the translation axis, while the print head units 102*b* and 102*c* have been moved away from the translation axis. In this manner, a desired distance between the print head units and the object's surface is maintained. Moreover, the orientation of all of the print head units has been changed, in order to maintain a desired orientation with respect to the regions of the object that are exposed to the print head units.

Figure 8A:
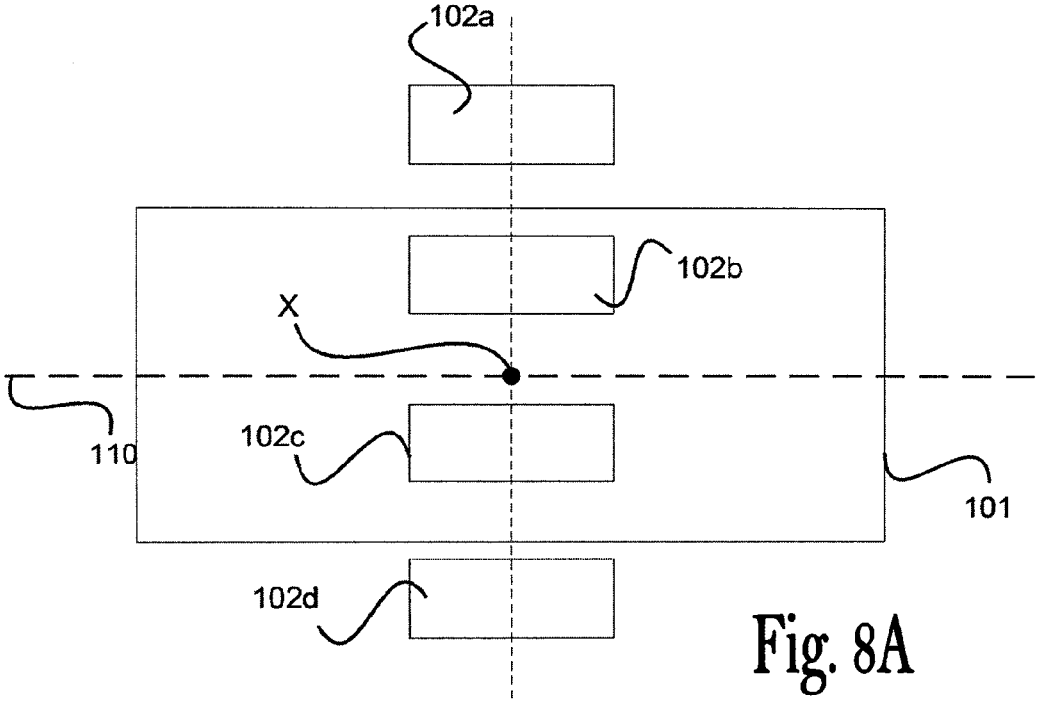
FIG. 8A is a schematic drawing exemplifying some embodiments in which the print head units belonging to the same group are positioned at the same location along the axis of translation.
Figure 8B:
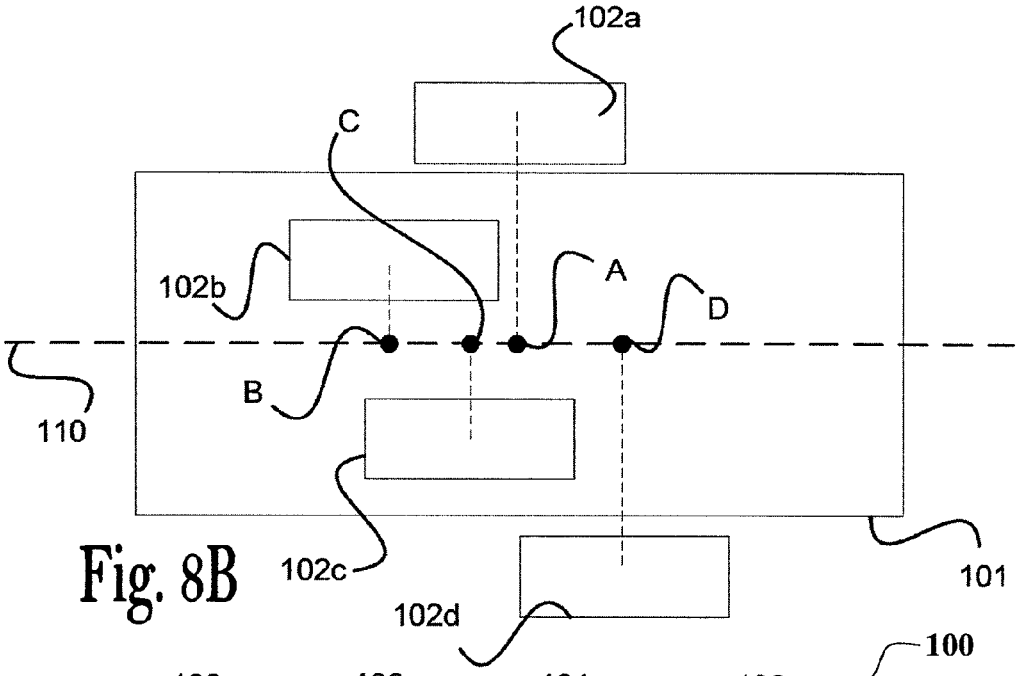
FIG. 8B is a schematic drawing exemplifying some embodiments in which the print head units belonging to the same group are staggered, being positioned at different locations along the axis of translation.

It should be noted that in the previous figures, print head units of the same group have been shown to be located at the same coordinate along the axis of translation 110. However, this need not be the case. Referring now to FIGS. 8A and 8B, exemplifying two optional arrangements of print head units belonging to a group. In FIG. 8A a schematic drawing exemplifies some possible embodiments in which the print head units belonging to the same group are positioned at the same location along the axis of translation 110. FIG. 8B is a schematic drawing exemplifying some possible embodiments in which the print head units belonging to the same group are staggered i.e., being positioned at different locations along the axis of translation 110.

In FIG. 8A, all the print head units belonging to the same group are positioned at a same location X along the axis of translation 110. In other words, the projections of the different print head units of the same group on the translation axis 110 fall on the same region of the translation axis. In FIG. 8B, each print head unit of the same group is positioned at a respective location along the translation axis 110. The print head unit 102*a* is centered at coordinate A on the axis of translation 110. The print head unit 102*b* is centered at coordinate B. The print head unit 102*c* is centered at coordinate C. The print head unit 102*d* is centered at coordinate D. In other words, projections along the translation axis of at least two of the print head units of the at least one group fall on a different regions of the translation axis 110.

Figure 9A:
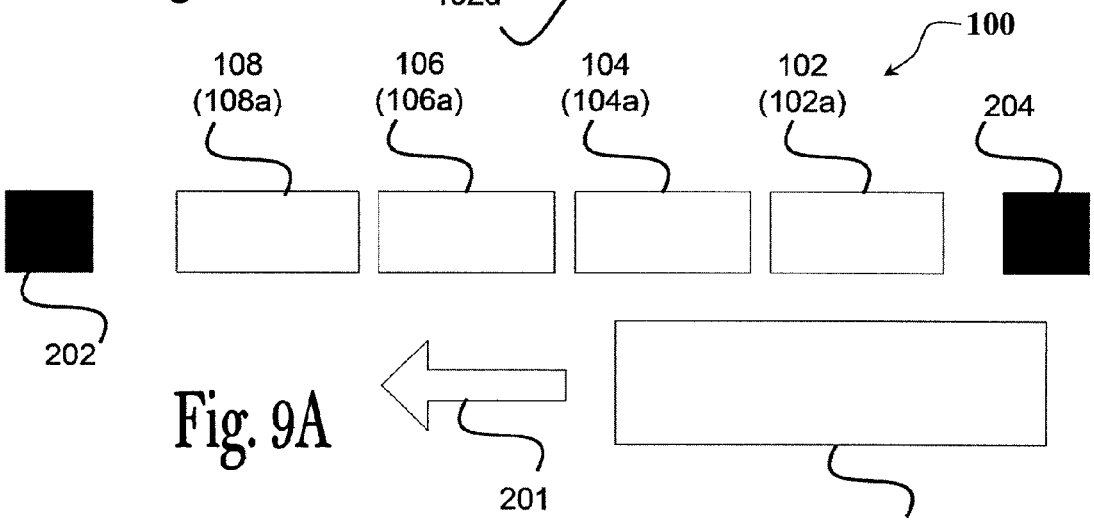
FIG. 9A is schematic drawing exemplifying some embodiments in which at least one curing/fixing station is located at the end of the print unit assembly, downstream of the last group of print head units and/or in which at least one priming/pretreatment station is located at the beginning of the print unit assembly, upstream from first group of print head units.

Referring now to FIG. 9A, which exemplifies some embodiments in which at least one curing/drying station is located at the end of the print unit assembly 100, downstream of the last group of print head units.

In FIG. 9A, the object 101 is moved from right to left, in the direction 201. During this translation, regions of the object's surface are successively exposed to the print head units of the groups 102, 104, 106, and 108 (or to print head units 102*a*, 104*a*, 106*a*, and 108*a*, if the print head assembly 100 is set according to FIGS. 2A and 2B) and printed upon. The printing may be continuous printing or step printing, as described above. In some embodiments of the present invention, a curing/drying station 202 is located downstream from the last group 108 (or the last print head unit 108*a*). After receiving ink from the print head units, the object 101 is moved to the curing/drying station, where the ink is fixed on the object's surface. The curing/drying may be performed according to any known technique, such as: exposing the printed surface to ultraviolet (UV) light without or with any combination of gas or external liquid to enhance the curing/drying speed; exposing the printed surface to an electrical beam (EB); heating the surface via exposure to IR (infra red) radiation; ventilation drying. These techniques maybe used for curing/drying after the printing is performed.

Techniques may also be used for priming/pretreating the object's surface prior to printing: exposing the printed surface of the object to a flame, and/or plasma, and/or corona, and/or surface cleaning equipment: and/or antistatic equipment; surface heating or drying equipment; applying a primer or coating material to the surface; exposing the surface printed or unprinted to a gas, such as nitrogen or an inert to enhance later curing. To this end, optionally, a priming station 204 is located upstream from the first print head group 102 (or the first print head unit 102*a*). In the priming station 204, the surface of the object 101 is treated so as to enhance the imminent printing upon it. The priming may be performed according to any of the above-mentioned manners used for priming/pretreating.

It should be noticed that the curing/drying station may include a single curing/drying unit or a group of curing/drying units set around the translation axis 110. Similarly, the priming station may include a single priming unit or a group of priming units set around the translation axis 110.

Figure 9B:
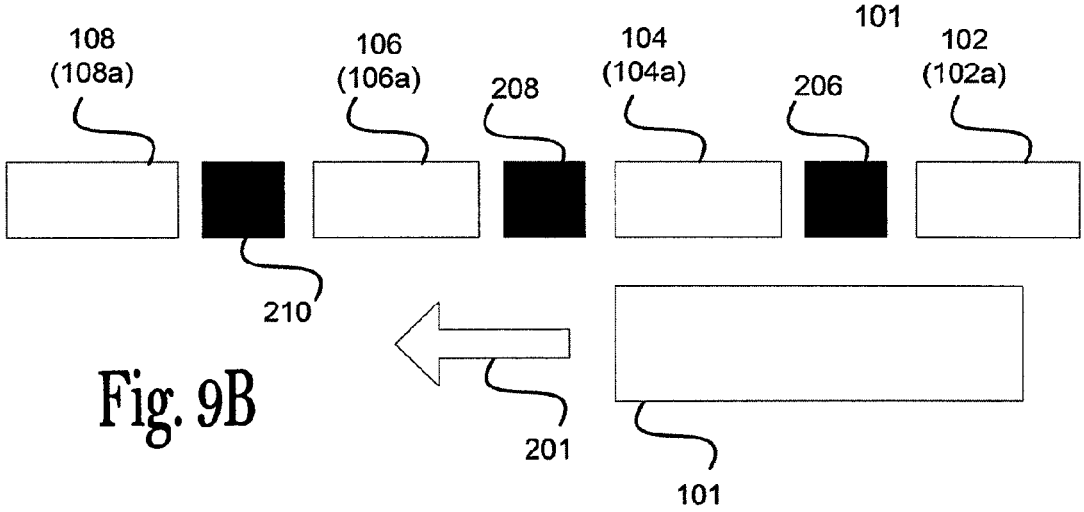
FIG. 9B is schematic drawing exemplifying some embodiments in which at least one curing/fixing station and/or priming/pretreatment station is located between two successive groups of print head units.

Referring now to FIG. 9B, a schematic drawing exemplifying some embodiments in which at least one curing/drying station and/or priming/pretreating station is located between two successive groups of print head units.

In some embodiments, it may be desirable to have a curing or priming station after (downstream from) one or some of the groups of print head units (or after some of the print head units located at successive positions along the axis of translation). For example, and without being limiting, if consecutive groups or print head units apply to the object compositions that may mix together and yield undesirable results a curing station is needed between these two consecutive groups or print head units. In another example, certain print head units or the print head units of a certain groups are configured for jetting a composition which needs a certain kind of priming prior to application on the object's surface. In this case, a priming station needs to be placed before the certain print head units or certain groups.

In the non-limiting example of FIG. 9B, a curing/drying and/or priming/pretreating station 206 is located between the groups 102 and 104 (or print head units 102*a* and 104*a*), a curing/drying and/or priming/pretreating station 208 is located between the groups 104 and 106 (or print head units 104*a* and 106*a*), and a curing/drying and/or priming/pretreating station 210 is located between the groups 106 and 108 (or print head units 106*a* and 108*a*).

Figure 9C:
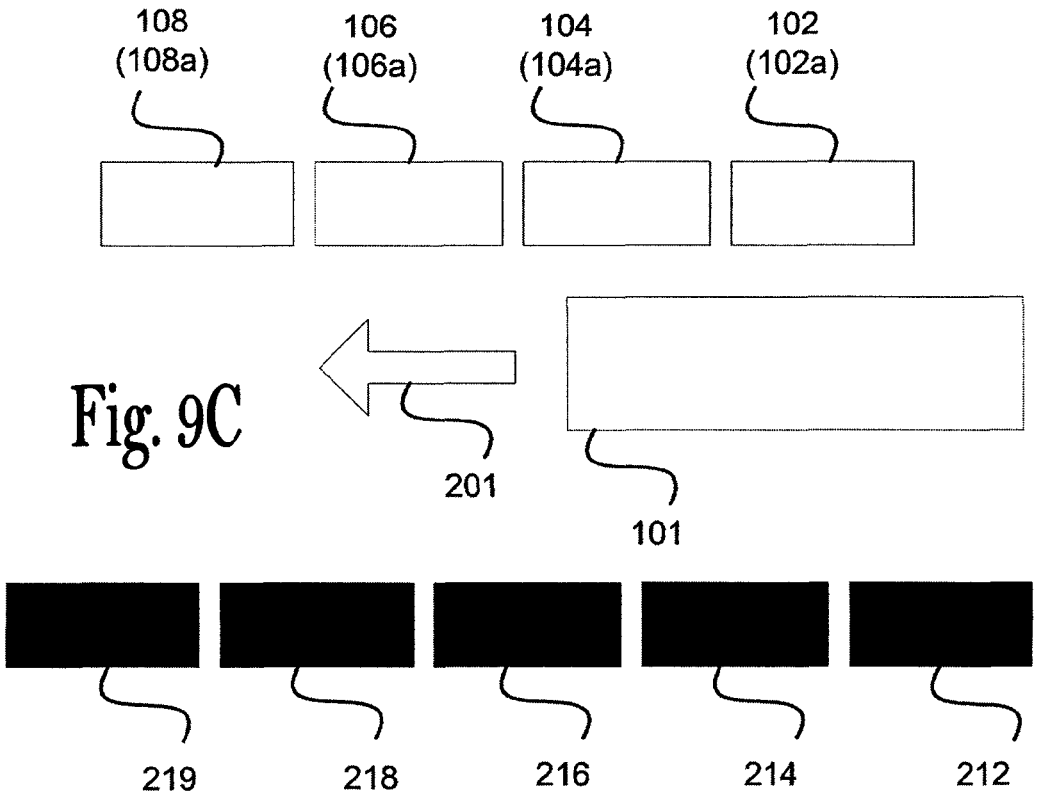
FIG. 9C is a schematic drawing exemplifying some embodiments in which a plurality of curing/fixing and/or priming/pretreatment stations are positioned one after the other along the axis of translation.

Referring now to FIG. 9C, a schematic drawing exemplifying some embodiments in which a plurality of curing/drying/priming/pretreating stations are positioned one after the other along the axis of translation. In this non-limiting example, the curing/drying/priming/pre-treating stations 212, 214, 216, 218, 219 are located below the object 101, while the print head groups (or the individual print head units) are located above the object 101. In this manner, the printing and the curing/drying/priming/pretreating may be performed simultaneously. Optionally, the stations 212, 214, 216, 218, 219 may be part of a single long station having a plurality of printing elements. This is advantageous since it creates a curing/drying/priming/pretreating to each printed layer on each cycle.

Figure 9D:
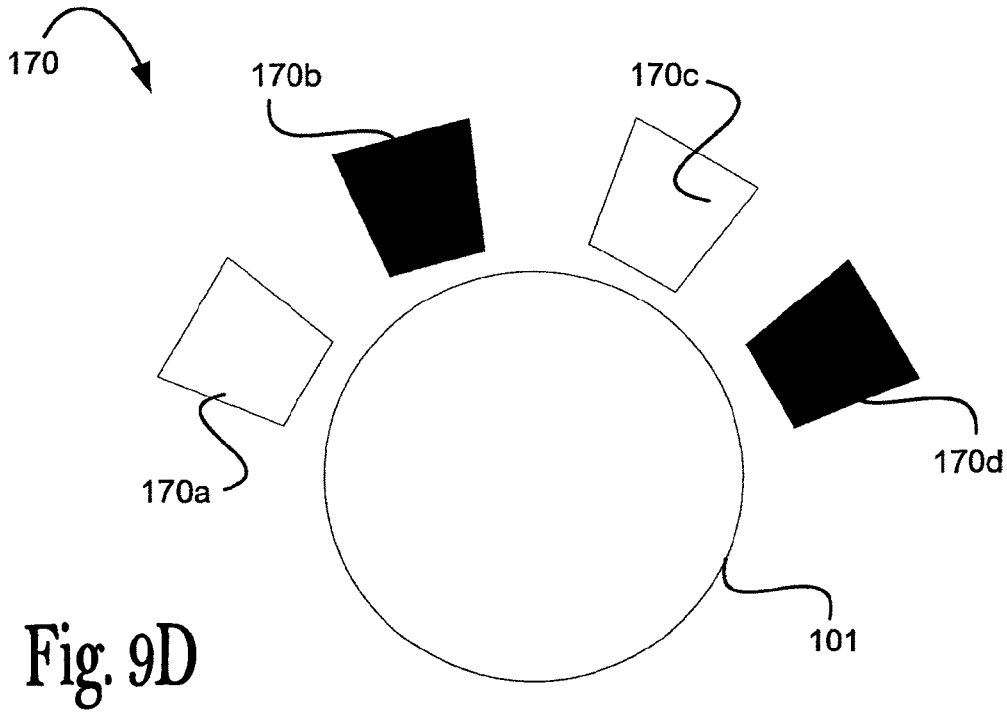
FIG. 9D is a schematic drawing exemplifying some embodiments in which at least one curing/fixing and/or priming/pretreatment unit is located between print head units of the same group.

Referring now to FIG. 9D, a schematic drawing exemplifying some embodiments in which at least one curing/drying and/or priming/pretreating unit is part of a group of print head units. In this non-limiting example, the group 170 includes print head units 170*a* and 170*c* and curing/drying and/or priming/pretreating units 170*b* and 170*d*. This enables curing/drying and/or priming/pretreating to be performed before, between, or after printing by individual print head units.

It is that in some embodiments shown in FIGS. 9A to 9D self-fixated inks may be advantageously used in the print head units 35. Such self-fixated inks are typically configured to instantly fixate after injected from the printing elements of the print head upon reaching the surface of the object. Accordingly, such possible embodiments employing self-fixated inks may utilize one curing zone at the end of the printing process. Furthermore, in such possible embodiments wherein a single curing zone is employed at the end of the printing process allows designing printing head assemblies having shorter lengths and higher accuracies.

Figure 10A:
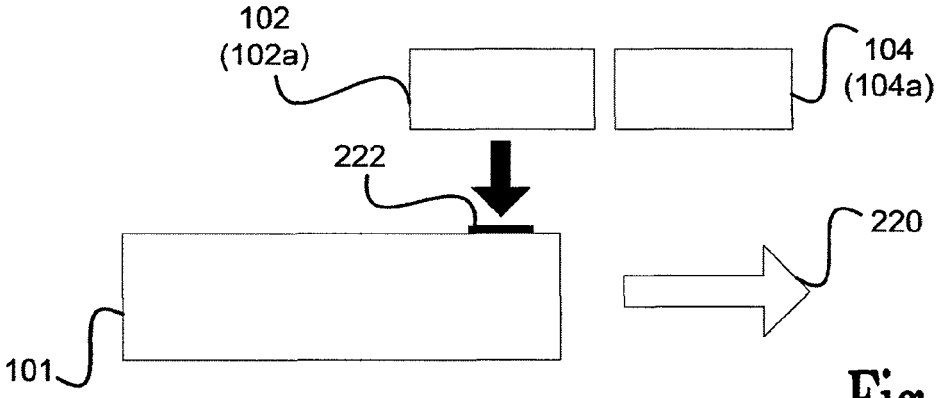
FIGS. 10A to 10C are schematic drawings illustrating some embodiments in which first and second compositions are jetted on the same location of the object's surface by print head units of first and second groups respectively, in order to print the location with a third composition which is formed by a combination of the first and second compositions.
Figure 10B:
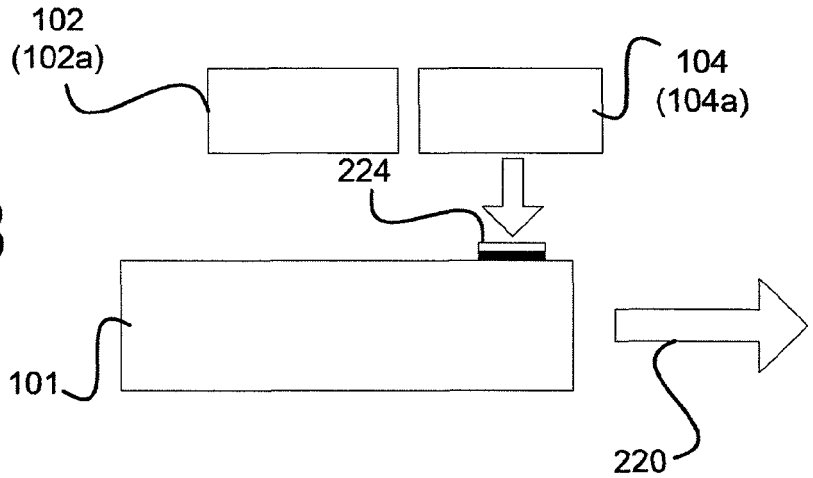
Figure 10C:
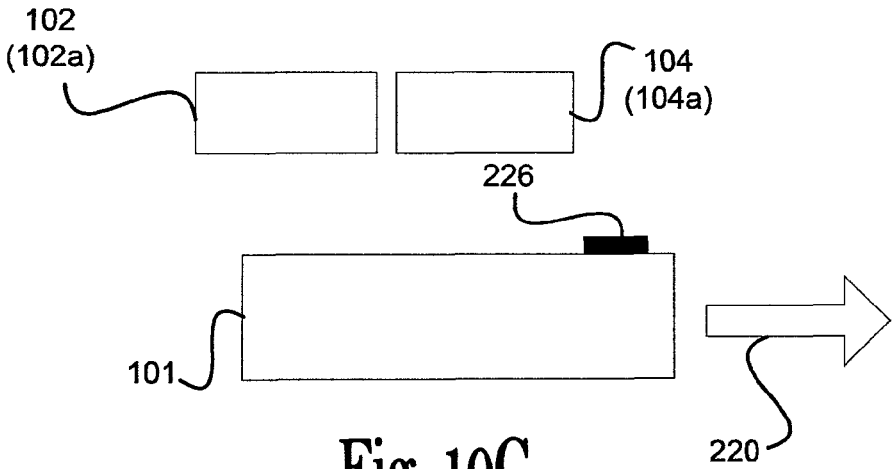

Referring now to FIGS. 10A to 10C, which are schematic drawings illustrating some possible embodiments in which first and second compositions are jetted on the same location of the object's surface by print head units of first and second groups respectively (or by first and second print head units), in order to print the location with a third composition which is formed by a combination of the first and second compositions.

In FIG. 10A, the object 101 is moved in the direction 220 along the axis of translation so that a certain region of the object's surface is exposed to a print head unit of a first group 102 (or to a first print head unit 102*a*, if the print head assembly is configured according to the examples of FIG. 2A or 2B). The print head unit jets a first composition 222 on the region of the object's surface, according to an instruction from the control unit (300). In FIG. 10B, the object 101 is moved in the direction 220 by the conveyor system (302), so that the region of the object's surface is exposed to a print head unit of a second group 104 (or to a second print head unit 104*a*). At this point, the control unit instructs the print head of the second group to jet a second composition 224 on the region which received the first composition. At FIG. 9*c*, the first and second compositions combine and yield a third composition 226. The combination of the first and second compositions may be a mixing or a chemical reaction. The mixing may be mixing of ink of two different colors for generating a desired ink of a third color.

This setup is advantageous in the instance in which the third composition 226 cannot be printed by the desired printing system. For example, and without being limiting, if the third composition is a solid, the third composition cannon be ejected in inkjet printing. The first and second liquid compositions are to be combined during the printing process according to the techniques of FIGS. 10A to 10C, if they are to be delivered by print head units in liquid form to the target area. On the target area, the combination between the liquid compounds will occur to form the solid composition.

A solid composition is an extreme example. In fact, even a desired liquid composition having fluid viscosity above a certain threshold cannot be delivered by certain print head units (many inkjet print head units, for example, can jet liquids having viscosity between 10-15 centipoises). However if the component compositions of the desired composition have a viscosity that is below the operating threshold of the print head units, the component compositions can be delivered by successive print head units and mix on the target area to form the more viscous desired composition.

Figure 11A:
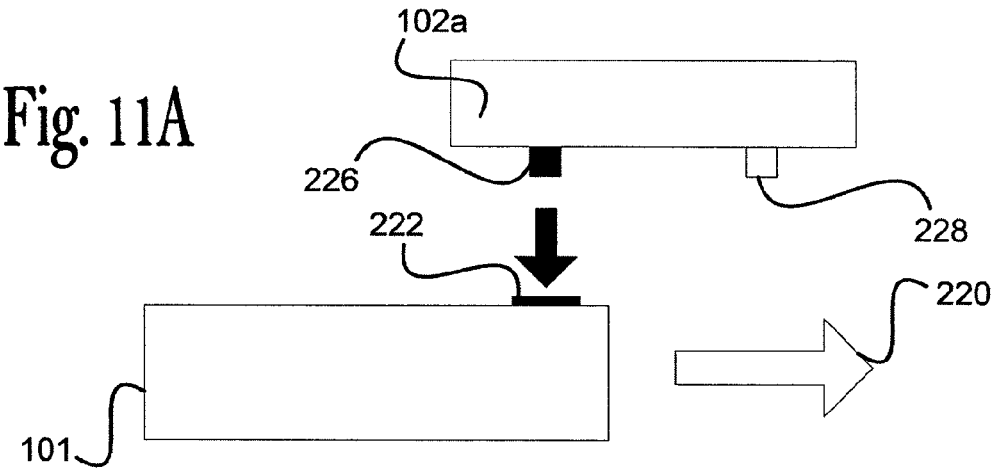
FIGS. 11A to 11C are schematic drawings illustrating some embodiments in which first and second compositions are jetted on the same location of the object's surface by different nozzles belonging to a single print head unit, in order to print the location with a third composition which is formed by a combination of the first and second compositions.
Figure 11B:
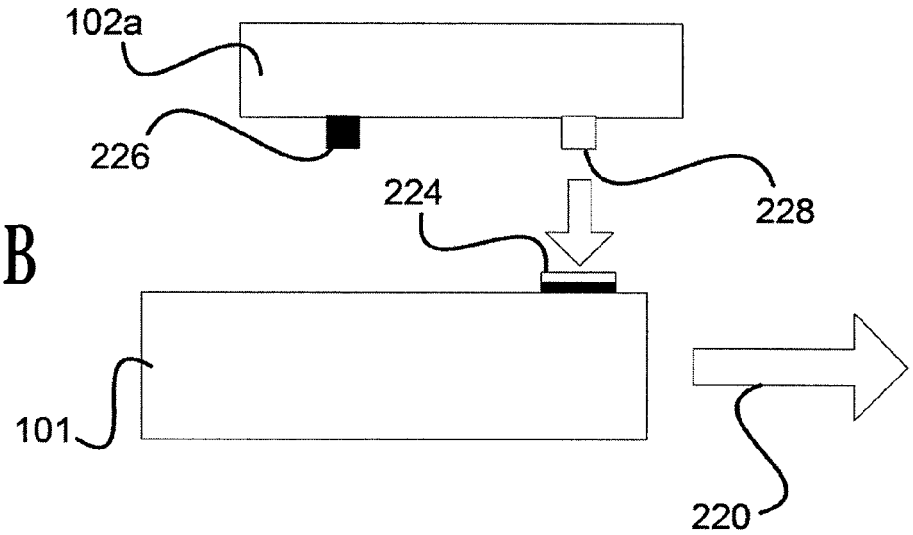
Figure 11C:
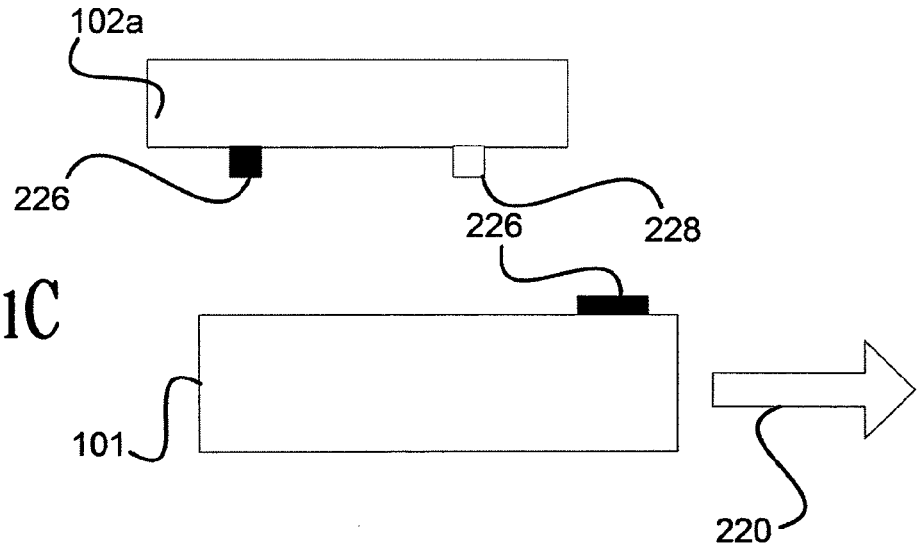

The combination of compositions described in FIGS. 10A to 10C may be achieved by a single print head unit 102*a* having at least two printing elements 226 and 228, as depicted by FIGS. 11A to 11C. In this non-limiting example, the first printing element 226 ejects the first composition 222 on a certain region of the surface of the object 101, and the second printing element 228 ejects the second composition 224 on the certain region of the surface of the object 101.

Figure 12A:
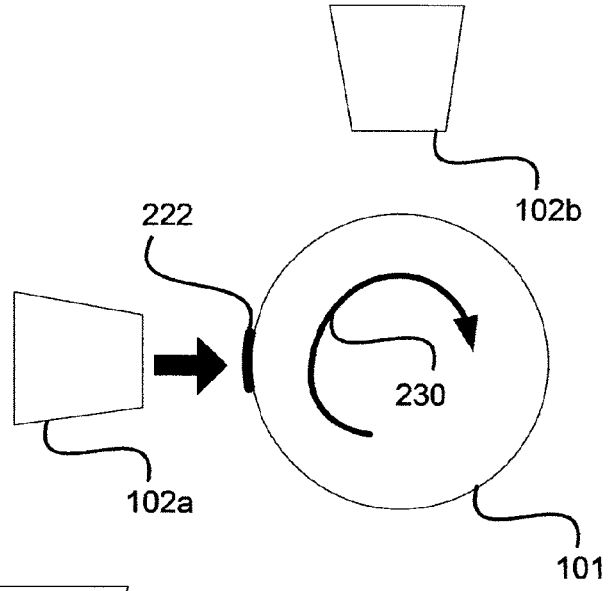
FIGS. 12A to 12C are schematic drawings illustrating some embodiments in which first and second compositions are jetted on the same location of the object's surface by respectively first and second print head units of the same group, in order to print the location with a third composition which is formed by a combination of the first and second compositions.
Figure 12B:
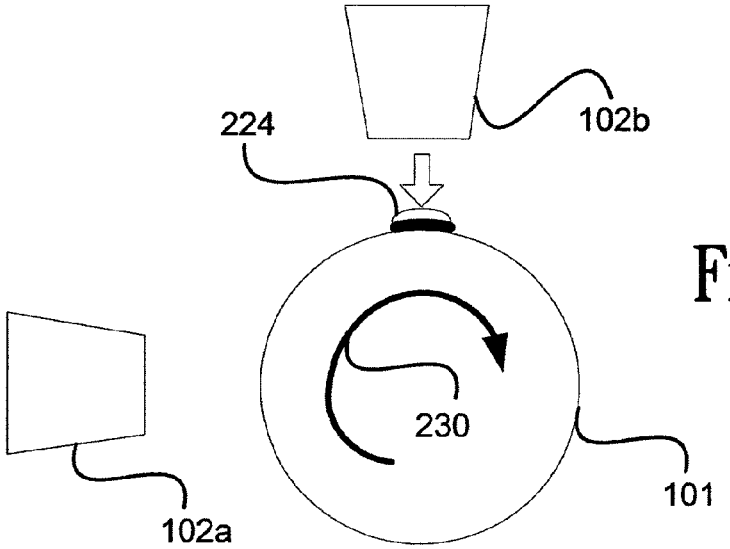
Figure 12C:
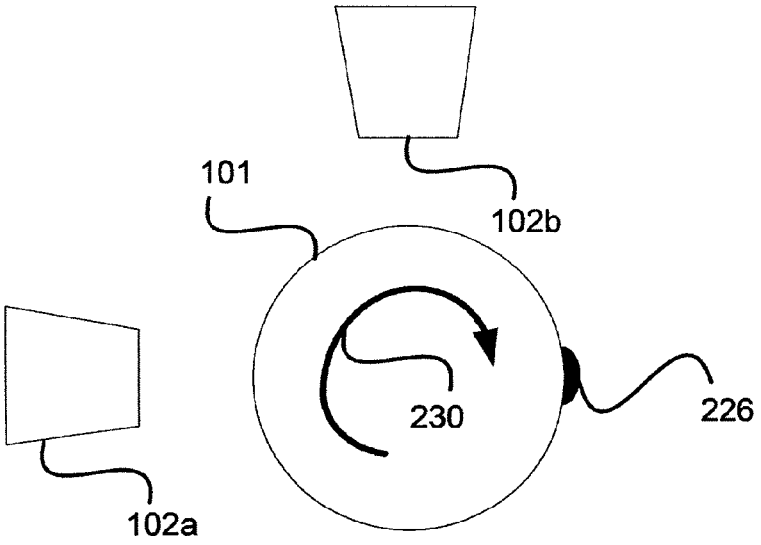

Referring now to FIGS. 12A to 12C, which are schematic drawings illustrating some possible embodiments in which first and second compositions are jetted on the same location of the object's surface by respectively first and second printing units of the same group, in order to print the location with a third composition which is formed by a combination of the first and second compositions.

In FIG. 12A, a first print head unit 102*a* jets a first composition 222 on a certain region of the object's surface, according to an instruction from the control unit (300), while the object rotates in the direction 230 around the axis of translation. In FIG. 12B, the object 101 is rotated in the direction 230, and the region which received the first composition 222 is brought to the vicinity of a second print head unit 102*b* belonging to the same group as the first print head unit 102*a*. At this point, the control unit instructs the second print head unit 102*b* to jet a second composition 224 upon the region which previously received the first composition 222. In FIG. 12*c*, the first and second compositions combine together (e.g., by reacting chemically or mixing) and yield a third composition 226. As above, this setup is advantageous in the instance in which the third composition 226 cannot be printed by the printing system.

It should be noted that though the examples of FIGS. 10A-10C, 11A-11C, and 12A-12C relate to printing a desired composition formed by two component compositions, the technique of FIGS. 10A-10C, 11A-11C and 12A-12C, can also be used for forming a desired composition by combining three or more component compositions.

Figure 13A:
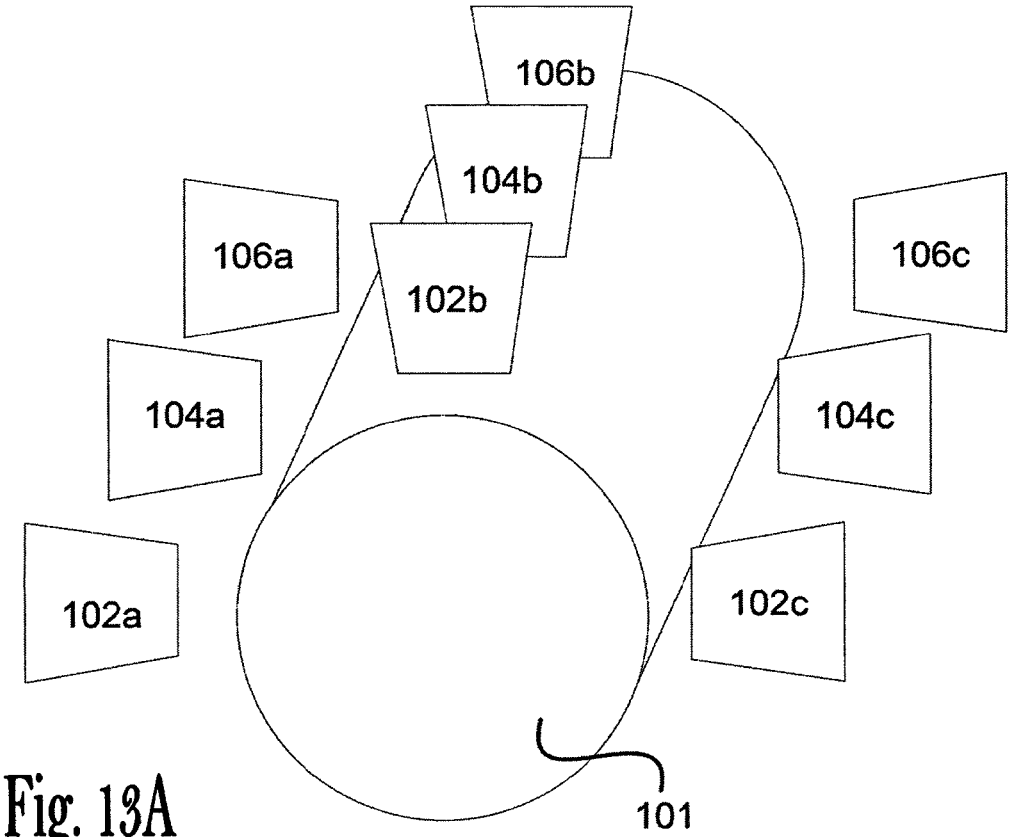
FIGS. 13A and 13B are schematic drawings exemplifying possible embodiment in which printing units belonging to different groups are located at the same position around the axis of translation, and are organized in bars/columns.
Figure 13B:
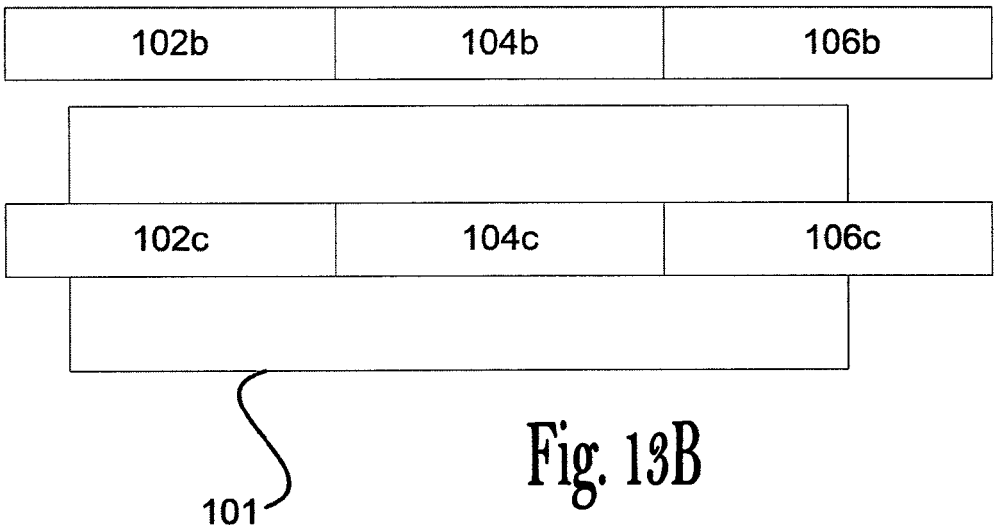

Referring now to FIGS. 13A and 13B, which are schematic drawings exemplifying possible embodiments in which print units belonging to different groups are located at the same position around the axis of translation, and are organized in bars/columns. In FIG. 13A a perspective view of the print head assembly is shown. In FIG. 13B, a side view of the print head assembly is shown.

As explained above, the print head units 102*a*, 102*b*, and 102*c* belong to a first group, the print head units 104*a*, 104*b*, and 104*c* belong to a second group, and the print head units 106*a*, 106*b*, and 106*c* belong to a third group. In the example of FIGS. 13A and 13B, the print head units 102*a*, 104*a*, and 106*a* are located at a first angular coordinate around the axis of translation. Similarly, the printing head units 102*b*, 104*b*, and 106*b* are located at a second angular coordinate around the axis of translation. Moreover, the printing head units 102*c*, 104*c*, and 106*c* are located at a third angular coordinate around the axis of translation. The printing head units 102*a*, 104*a*, and 106*a* form a column substantially parallel to the translation axis (as do the printing head units 102*b*, 104*b*, and 106*b*, and the printing head units 102*c*, 104*c*, and 106*c*).

In each column, the printing heads are joined to each other and form bars. The location of the print head units during printing is critical for achieving a successful printing. The print head units are to be aligned with each other along the translation axis at a high precision for high-resolution printing. Therefore, aligning the print head units with respect to each other is an important part of the printing process. The advantage of having the printing heads arranged in bars/columns lies in the fact that rather than adjusting a position of each printing head individually prior to printing, the positions of the bars/columns along the translation axis are adjusted. By adjusting the position of each bar/column, the position of a plurality of printing head units which constitute the bar/column is adjusted. Thus, once the position of the first bar/column is chosen, all the other bars/columns must simply be aligned with the first bar/column. This enables a precise and quick adjustment of the location of the printing heads prior to printing.

Though subsequent print head units of any bar of FIGS. 13A and 13B are shown to be joined to each other, this is not necessarily the case. In fact, a bar/column can include at least two subsequent print head units set so as to define an empty space therebetween.

Figure 14:
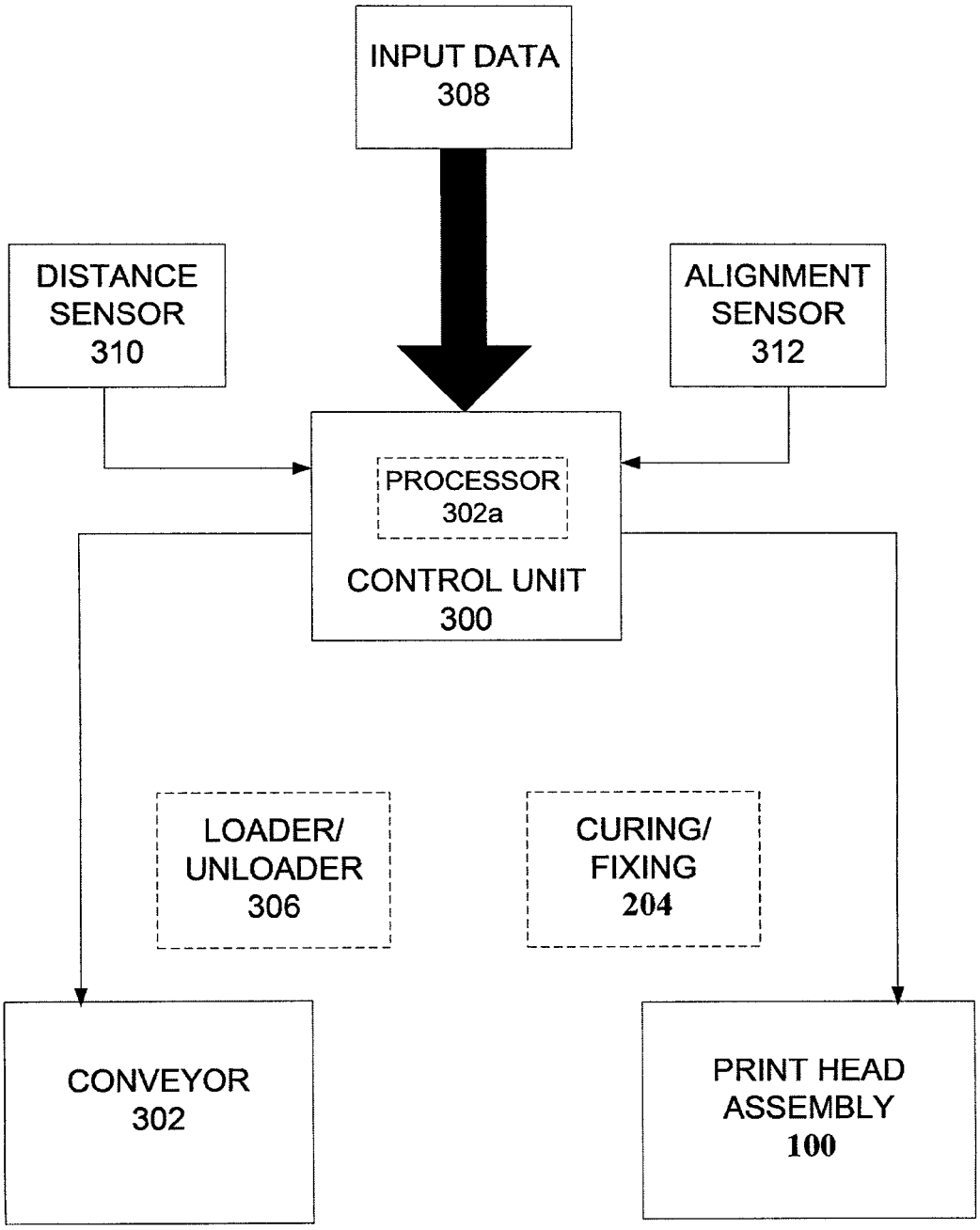
FIG. 14 is a block diagram illustrating a control unit usable according to some possible embodiments to control the conveyor system and print head assembly according to one or more kinds of input data.

Referring now to FIG. 14, which is a block diagram illustrating an embodiment of the system 200 in which a control unit 300 controls the conveyor and print head assembly according to one or more kinds of input data.

The system 200 in this non-limiting example includes a control unit 300, a conveyor system 302, and a print head assembly 100, all of which have been described hereinabove. The print head assembly 100 may, or may not, include one or more priming (204) and/or curing (202) units or stations, as described hereinabove. Optionally, the system 200 includes a loader/unloader unit 306 configured for loading the object(s) onto the conveyor system 302 and unloading the object(s) from the conveyor system 302 once the printing (and optionally curing/drying and/or priming/pretreating) is completed. The control unit 300 operates the conveyor system 302, the print head assembly 100, and the loader/unloader device 306 (if present), to create a desired sequence of operations of these elements (printing pattern), in order to yield a printed image on the object (101).

Optionally, the sequence of operations is transmitted to the control unit 300 from an outer source as input data 308. The outer source may be a computer, which computes a suitable sequence of operations based on properties (e.g., colors, size, etc.) of an image which is to be printed on the object. In a variant, the control unit 300 includes a processor 302*a* configured for processing the image and determining the desired sequence of operations. In this case, the input data 308 is data indicative of the image to be printed, which the processor 302*a* uses to determine the sequence of operations.

In a variant, the system 200 includes a distance sensor 310 and an alignment sensor 312. The distance sensor 310 is configured for sensing the distance between at least one print head unit and the surface of the object. The alignment sensor 312 is configured for determining whether print head units (or bars/columns of such units, if present) are properly aligned with each other along the translation axis and/or around the translation axis.

The control unit 300 receives data from the distance sensor 310 and alignment sensor 312 in order to determine whether the print head units are in their proper positions, and determines whether or not to move them. In a variant, the control unit 300 instructs the print head units to move to their assigned positions before the printing starts (perpendicularly to the translation axis according to data from the distance sensor 310, and/or along and/or around the translation axis according to data from the alignment sensor 312). In another variant, the control unit 300 instructs the print head units to move to their assigned positions during the printing (for example, if the cross-sectional shape of the object varies along the object's length or the object's cross section is not circular, as explained above).

The distance sensor 310 and the alignment sensor 312 may operate by emitting radiation (e.g., electromagnetic, optical, acoustic) toward a target and receiving the radiation reflected/scattered by the target. A property of the received radiation (e.g., time period after emission, phase, intensity, etc.) is analyzed in order to determine the distance between the sensor and the target.

According to a first variant, a distance sensor element is mounted on at least one of the print head units and is configured for emitting radiation to and receiving radiation from the object. According to a second variant the distance sensor is an external element which determines the position of a print head unit and of the object's surface, and calculates the distance therebetween.

Similarly, in a variant, an element of the alignment sensor 312 is mounted on a print head unit and is configured for emitting radiation to and receiving radiation from another print head unit. In another variant, the alignment sensor 312 includes an external element configured for determining the position of two print head units (or bars/columns of such units) and calculating the distance therebetween.

In some embodiments of the present invention, the distance sensor and alignment sensor are not present, and a calibration process is required prior to printing. In the calibration process, the print head units of the assembly 100 are moved to their positions prior to printing, and a trial printing is performed. The image printed in the trial printing is analyzed either by a user or by a computer (e.g., an external computer or the control unit itself), and the positions of the print head units are adjusted accordingly, either manually or automatically. Once this calibration process is finished, the printing of one or more objects can take place.

FIGS. 15 to 21 demonstrate a printing system 17 according to some possible embodiments. In general, the printing system 17 shown in FIGS. 15 to 21 is configured to maintain and handle a continuous feed of objects 101 (also referred to herein as a stream of objects) to be printed on, while maintaining minimum gap (e.g., about 2 mm to 100 mm) between adjacent objects 101.

Figure 15:
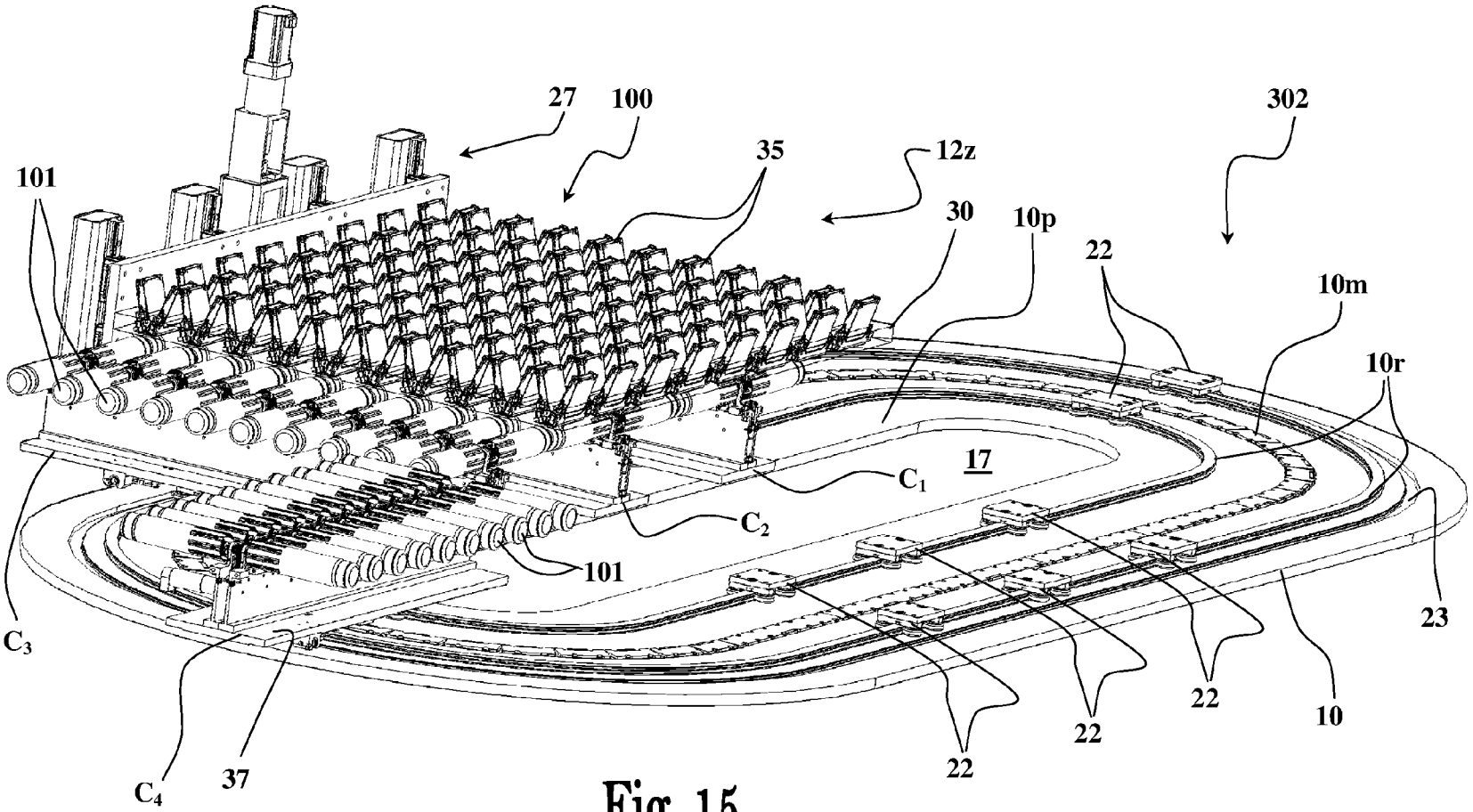
FIG. 15 schematically illustrates a conveyor system according to some possible embodiments.

With reference to FIG. 15, in this non-limiting example the printing system 17 generally comprises the closed loop lane 10 and the print head assembly 100 mounted in the printing zone 12*z* of the lane 10 on elevator system 27. Other parts of the printing system (e.g., priming unit, curing unit, etc.) are not shown for the sake of simplicity. The lane 10 is generally a circular lane; in this non-limiting example having a substantially elliptical shape. The lane 10 may be implemented by an elliptical ring shaped platform 10*p* comprising one or more tracks 10*r* each having a plurality of sliding boards 22 mounted thereon and configured for sliding movement thereover. At least two sliding boards 22, each mounted on a different track 10*r*, are radially aligned relative to the lane 10 to receive a detachable platform 37 and implement a carriage $C_i$ configured to hold a plurality of objects 101 to be printed on, and advance them towards the printing zone 12*z*. In this non-limiting example the lane 10 comprises two tracks 10*r* and the sliding boards 22 slidably mounted on the tracks 22 are arranged in pairs, each sliding board of each pair of sliding boards being slidably mounted on a different track 22, such that a plurality of slidable carriages $C_1$, $C_2$, $C_3$, . . . , are constructed by attaching a detachable platform 37 to each one of said pairs of sliding boards 22.

Implementing an elliptical lane 10 may be carried out using straight rails connected to curved rails to achieve the desired continuous seamless movement on the elliptical track. Accordingly, the sliding boards 22 may be configured to enable them smooth passage over curved sections of the lane 10. Printing zones 12*z* of the lane 10 are preferably located at substantially straight portions of the elliptical lane 10 in order devise printing zones permitting high accuracy, which is difficult to achieve over the curved portions of the lane 10. In some embodiments curved shape tracks have runners with a built in bearing system's tolerance to allow the rotation required by the nonlinear/curved parts of the track. Those tolerances typically exceed the total allowable error for the linear printing zone 12*z*. In the printing linear zone 12*z*, the tolerable errors allowed are in the range of few microns, due to high resolution requirements for resolution greater than 1000 dpi for high image qualities/resolutions. For such high resolutions require 25 micron between dots lines, which means that about ±5 micron dot accuracy is required in order for the sliding boards to pass the printing zone 12*z* in an accumulated printing budget error in X,Y,Z axis that will not pass the required ±5 micron tolerable dots placement position error.

The printing head assembly 100 comprises an array of printing head units 35 removably attached to a matrix board 30 and aligned thereon relative to the tracks 10*r* of the lane 10. The matrix board 30 is attached to the elevator system 27 which is configured to adjust the height of the printing elements of the printing heads units 35 according to the dimensions of the objects 101 held by the carriages $C_1$, $C_2$, $C_3$, . . . , approaching the printing zone 12*z*.

Figure 16A:
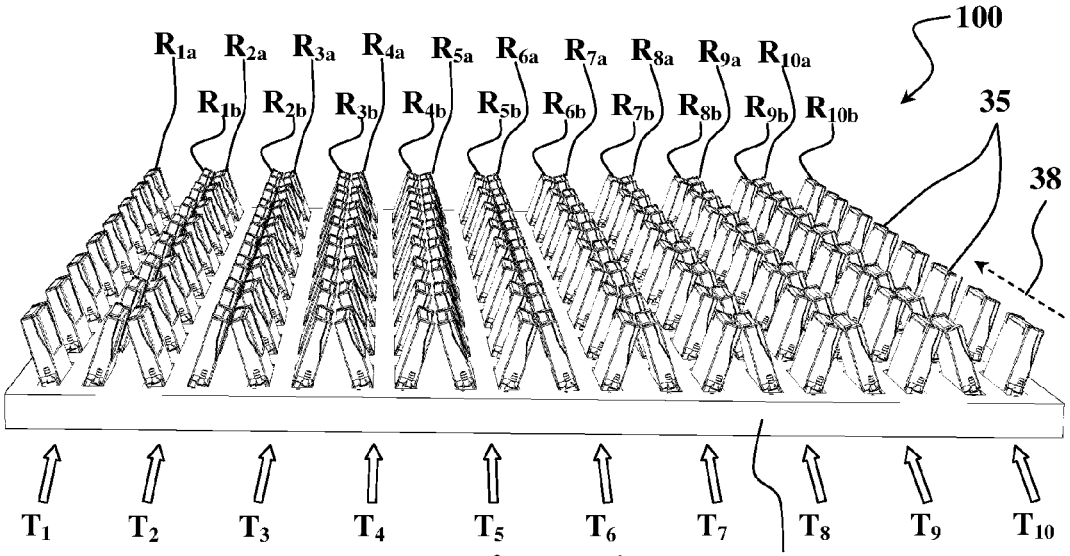
FIGS. 16A and 16B schematically illustrate arrangement of the print head assembly in the form of an array according to some possible embodiments.
Figure 16B:
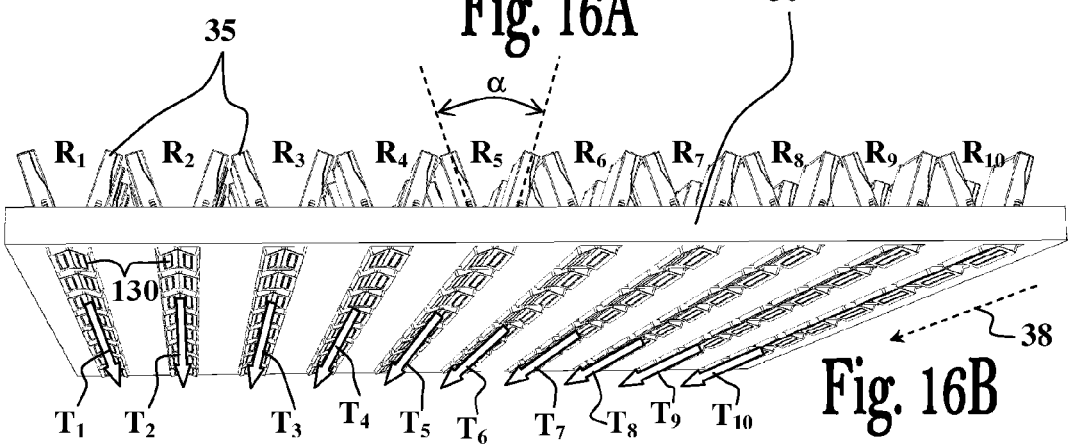

Referring now to FIGS. 16A and 16B, the array of print head units 35 of print head assembly 100 may comprise a plurality of sub-arrays $R_1$, $R_2$, $R_3$, . . . , of print head units 35, each one of said sub arrays $R_1$, $R_2$, $R_3$, . . . , configured to define a respective printing route $T_1$, $T_2$, $T_3$, . . . , in the printing zone 12*z*. As illustrated in 16A and 16B, the printing routes $T_1$, $T_2$, $T_3$, . . . , are defined along a printing axis 38 e.g., being substantially aligned with a the tacks 10*r* of the lane 10. In this way, objects 101 moved along a printing route $T_j$ (j=1, 2, 3, . . . ) are passed under the printing elements 130 of the print heads of the respective sub-array $R_j$.

Each carriage $C_i$ being loaded onto the lane 10 at a loading zone (306*l*) with a plurality of objects 101 is advanced through the various stages of the printing system 17 (e.g., priming 204, printing 12*z*, curing 202 and inspection 16), and then removed from the lane 10 at an unload zone 306*u*, thereby forming a continuous stream of objects 101 entering the lane and leaving it after being printed on, without interfering the movement of the various carriages $C_i$. In this way, the closed loop lane 10 provides for a continuous feed of carriages $C_1$, $C_2$, $C_3$, . . . , loaded with objects 101 into the printing zone 12*z*, and independent control over the position and speed of each carriage $C_i$ (i=1, 2, 3, . . . ) maintains a minimum gap (e.g., of about 1 cm) between adjacent carriages $C_i$ in the printing zone 12*z*.

In this non-limiting example the print head assembly 100 comprises ten sub-arrays (j=1, 2, 3, . . . , 10) of printing head units 35, each sub-array $R_j$ comprising two columns, $R_{ja}$ and $R_{jb}$ (j=1, 2, 3, . . . , 10), of printing head units 35. The printing head units 35 in the columns $R_{ja}$ and $R_{jb}$ of each sub-array may be slanted relative to the matrix board 30, such that printing elements 130 of the printing head units of one column $R_{ja}$ are located adjacent the printing elements 130 of the printing head units of other column of the sub-array column $R_{jb}$. For example, and without being limiting, the angle $\alpha$ between two adjacent print head units $R_{ja}$ and $R_{jb}$ in a sub-array $R_j$ may generally be about 0° to 180°, depending on the number of print head units used. The elevator system 27 is configured to adjust the elevation of the print head units 35 according the geometrical dimensions of the objects 101 e.g., diameter. For example, in some possible embodiments the printing head assembly 100 is configured such that for cylindrical objects having a diameter of about 50 mm the printing heads 35 are substantially perpendicular to a tangent at the points on the surface of the object under the printing elements 130 of said printing heads 35. For cylindrical objects having a diameter of about 25 mm the angles between the printing heads remains in about 73 degrees and the tangent is not preserved, which in effect results in a small gap between the printing elements 130 of the print heads 35 and the surface of the objects located beneath them. The formation of this gap may be compensated by careful scheduling the time of each discharge of ink through the printing elements 130 according the angular and/or linear velocity of the object and the size of gap formed between the printing elements 130 and the surface of the objects 101.

Angular distribution of the print heads is advantageous since it shortens the printing route (e.g., by about 50%), by densing the number of nozzles per area, and as a result shortening the printing zone 12*z* (that is very accurate), thereby leading to a total track length that is substantially shortened.

Figure 17:
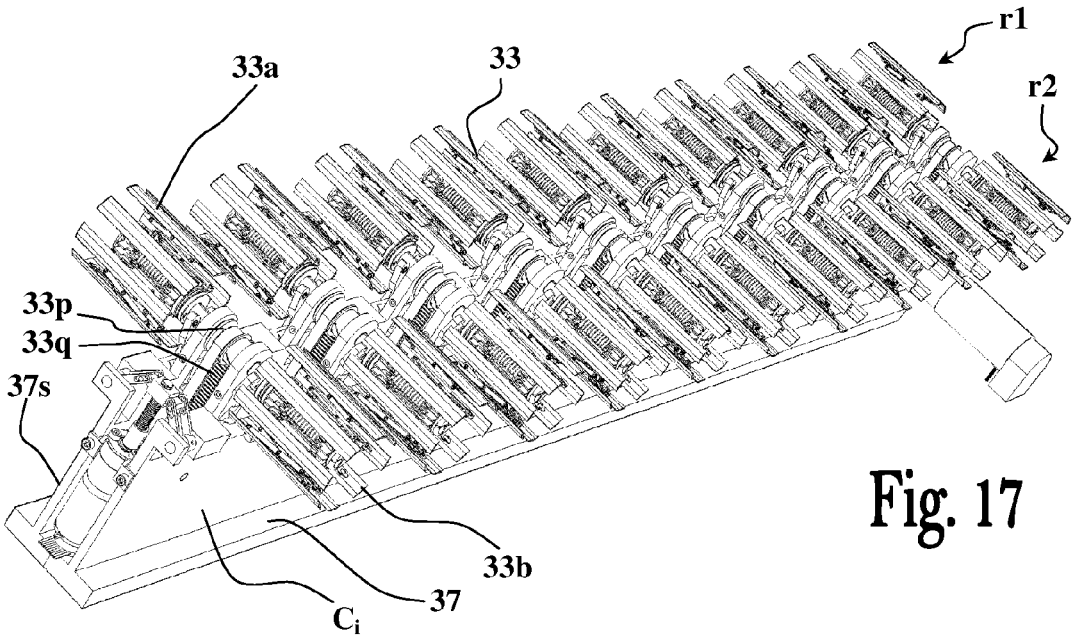
FIG. 17 schematically illustrates a carriage and an arrangement of mandrels mounted thereon, configured to hold objects to be printed on and translate and rotate them over the conveyor system.

FIG. 17 illustrates a structure of a carriage $C_i$ according to some possible embodiments. In this non-limiting example the carriage $C_i$ comprises an arrangement of rotatable mandrels 33 mounted spaced apart along a length of the carriage $C_i$. More particularly, the rotatable mandrels 33 are arranged to form two aligned rows, r1 and r2, of rotatable mandrels 33, wherein each pair of adjacent mandrels 33*a* and 33*b* belonging to different rows are mechanically coupled to a common pulley 33*p* rotatably mounted in a support member 37*s* vertically attached along a length of the detachable platform 37. The mandrels 33*a* and 33*b* of each pair adjacent mandrels 33 belonging to different rows r1 and r2 are mechanically coupled to a single rotatable shaft, which is rotated by a belt 33*q*.

In some embodiments the same belt 33*q* is used to simultaneously rotate all of the pulleys 33*p* of the rotatable mandrels arrangement, such that all the mandrels 33 can be controllably rotated simultaneously at the same speed, or same positions, and direction whenever the carriage $C_i$ enters any of the priming, printing, and/or curing, stages of the printing system 17. A gap between pairs of adjacent mandrels 33*a* and 33*b* belonging to the different rows r1 and r2 of mandrels may be set to a minimal desirable value e.g., of about 30 mm Considerable efficiency may be gained by properly maintaining a small gap between carriages (e.g., about 1 cm) adjacently located on the lane 10, and setting the gap between pairs of mandrels 33*a* and 33*b* belonging to the different rows r1 and r2 (e.g., about 30 mm, resulting in efficiency that may be greater than 85%).

In order to handle the multiple mandrels 33 of each carriage $C_i$ and obtain high printing throughput, in some embodiments all mandrels are rotated with a speed accuracy tolerance smaller than 0.5% employing a single driving unit (not shown). Accordingly, each carriage $C_i$ may be equipped with a single rotation driver and motor (not shown), where the motor shaft drives all of the mandrels 33 using the same belt 33*q*. In some embodiments the speed of the rotation of the mandrel 33 is monitored using a single rotary encoder (not shown) configured to monitor the rotations of one of the pulleys 33*p*. In this non-limiting example, each row (r1 or r2) of mandrels 33 includes ten pulleys 33*p*, each pulley configured to rotate two adjacent mandrels 33*a* and 33*b* each belonging to a different row r1 and r2, such that the belt 33*q* concurrently rotates the ten pulleys, and correspondingly all twenty mandrels 33 of the carriage $C_i$ are thus simultaneously rotated at the same speed and direction.

Figure 18:
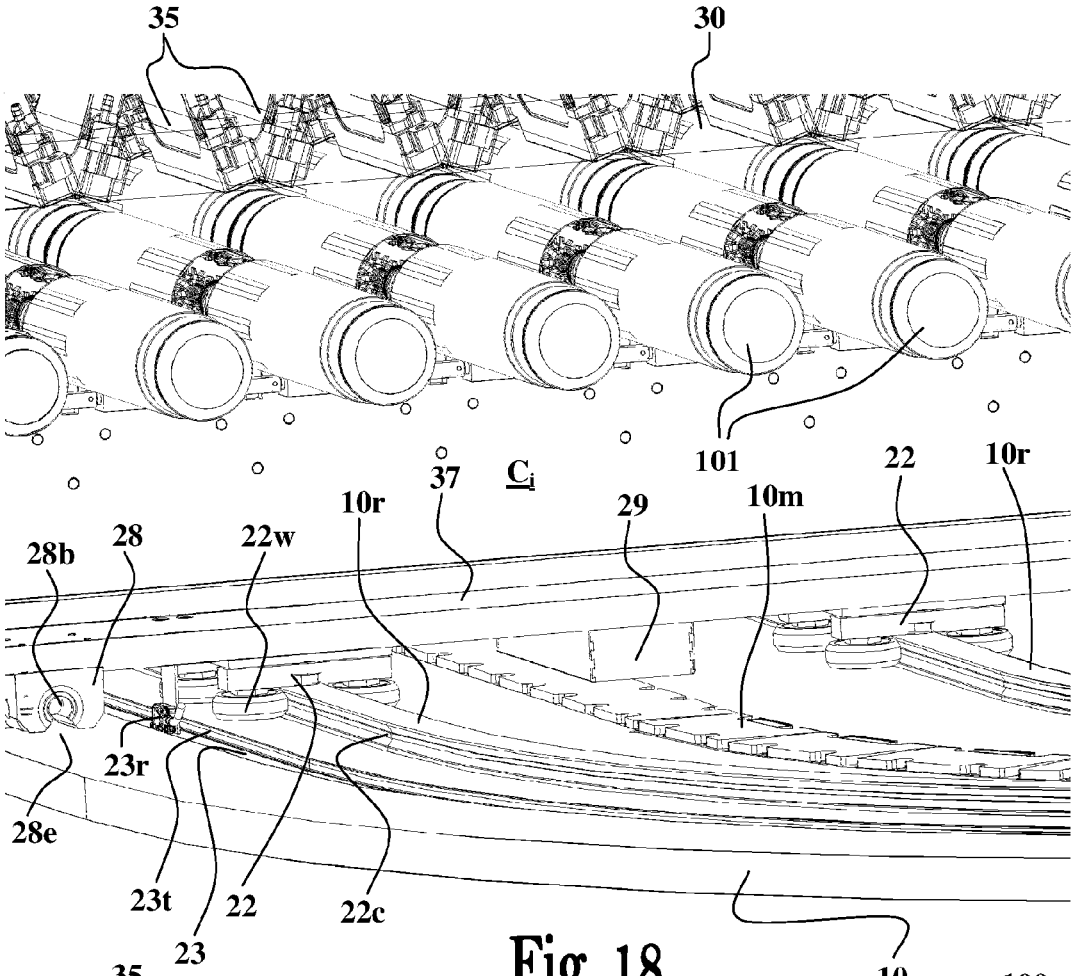
FIG. 18 schematically illustrates a carriage loaded with a plurality of objects to be printed entering a printing zone of the system.

FIG. 18 shows the coupling of the carriage $C_i$ to the lane 10 according to some possible embodiments. Each sliding board 22 in this non-limiting example comprises four horizontal wheels 22*w*, where two pairs of wheels 22*w* are mounted on each side of the sliding board 22 and each pair of wheels 22*w* being pressed into side channels 22*c* formed along the sides of the tracks 10*r*. The lane 10 may further include a plurality of magnet elements 10*m* mounted therealong forming a magnet track (secondary motor element) for a linear motor installed on the carriages $C_i$. A linear motor coil unit 29 (forcer/primary motor element) mounted on the bottom side of each detachable platform 37 and receiving electric power from a power source of the carriage (e.g., batteries, inductive charging, and/or flexible cable) is used for mobilizing the carriage over the lane. An encoder unit 23*r* attached to the bottom side of the carriage $C_i$ is used to provide real time carriage positioning signal to the controller unit of the carriage. Each carriage $C_i$ thus comprises at least one linear motor coil and at least one encoder so as to allow the control unit 300 to perform corrections to the positioning of the carriage $C_i$. In this way linear motor actuation of the carriages $C_i$ may be performed while achieving high accuracy of position of carriage movement, over the linear and curved areas of the lane 10.

For example, and without being limiting, the magnetic track 10*m* used for the linear motors may be organized in straight lines over the straight portions of the lane 10, and with a small angular gap in the curved portion of the lane 10. In some embodiments this small angular gap is supported by special firmware algorithm provided in the motor driver to provide accurate carriage movements. The lane may further include an encoder channel 23 comprising a readable encoded scale 23*t* on a lateral side of the channel 23. The encoder scale 23*t* is preferably placed around the entire elliptical lane 10, and the encoder unit 23*r* attached to the bottom side of each carriage $C_i$ is introduced into the encoder channel 23 to allow real time monitoring of the carriage movement along the lane 10.

High resolution encoding allows closing of position loops in accuracy of about 1 micron. For example, and without being limiting, the improved accuracy may be used to provide carriage location accuracy of about 5 microns, in-position time values smaller that 50 msec in the printing zone 12*z*, and speed accuracy smaller than 0.5%.

Figure 19:
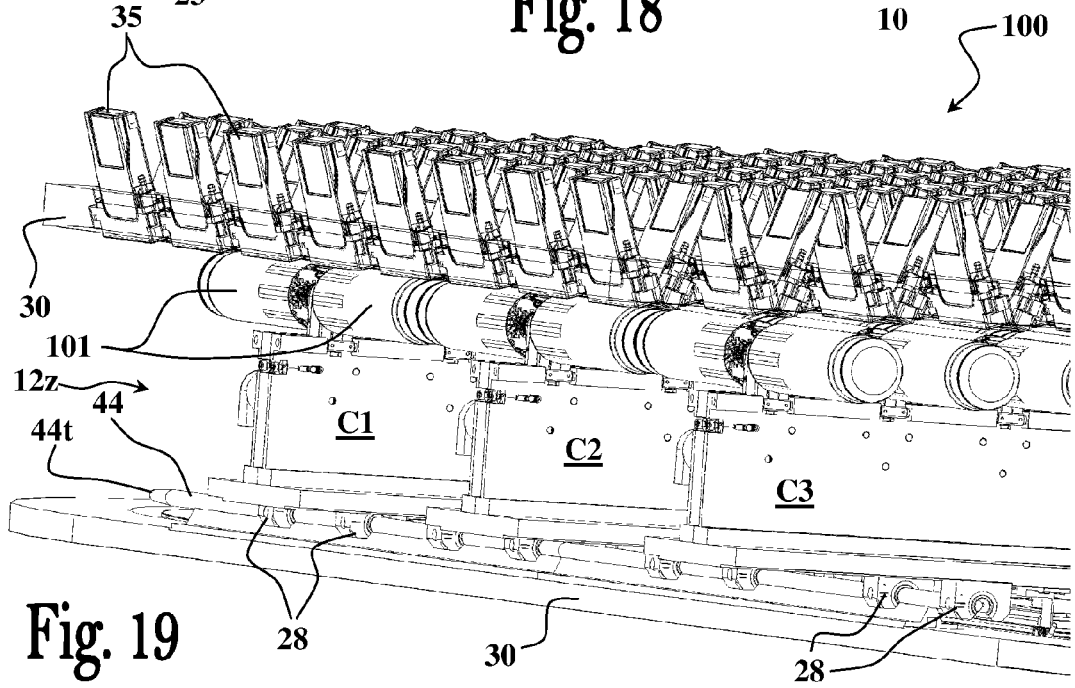
FIG. 19 schematically illustrates simultaneous printing on a plurality of objects attached to three different carriages traversing the printing zone.

FIG. 19 schematically illustrates simultaneous printing by the print head assembly 100 on surfaces of a plurality of objects 101 carried by three different carriages, $C_1$, $C_2$ and $C_3$. In order to enabler high printing resolutions, the movement of the carriages $C_i$ in the printing zone 12*z* should be carried out with very high accuracy. For this purpose, in some embodiments, a highly accurate (of about 25 micron per meter) linear rod 44 is installed along the printing zone 12*z*, and each carriage $C_i$ is equipped with at least two open bearing runners 28 which become engaged with the linear rod 44 upon entering the printing zone 12*z*. In order to facilitate receipt of the linear rod 44 inside the bearing runners 28, in some embodiments the linear rod 44 is equipped with a tapering end sections 44*t* configured for smooth insertion of the rod 44 into the opening 28*b* (shown in FIG. 18) of the bearing runners 44. A combination of individual carriage control (driver and encoder on each carriage) allows recognition of the exact position of the tapering entry section 44*t* for allowing the carriage $C_i$ to perform slow and smooth sliding of the bearing 28 onto the rod 44, thereby preventing direct damage to the bearings 28 and to the rod 44. The engagement of the carriage to the linear rod 44 is supported by a special firmware in the controller of the carriage and/or on the motor driver.

Figure 20:
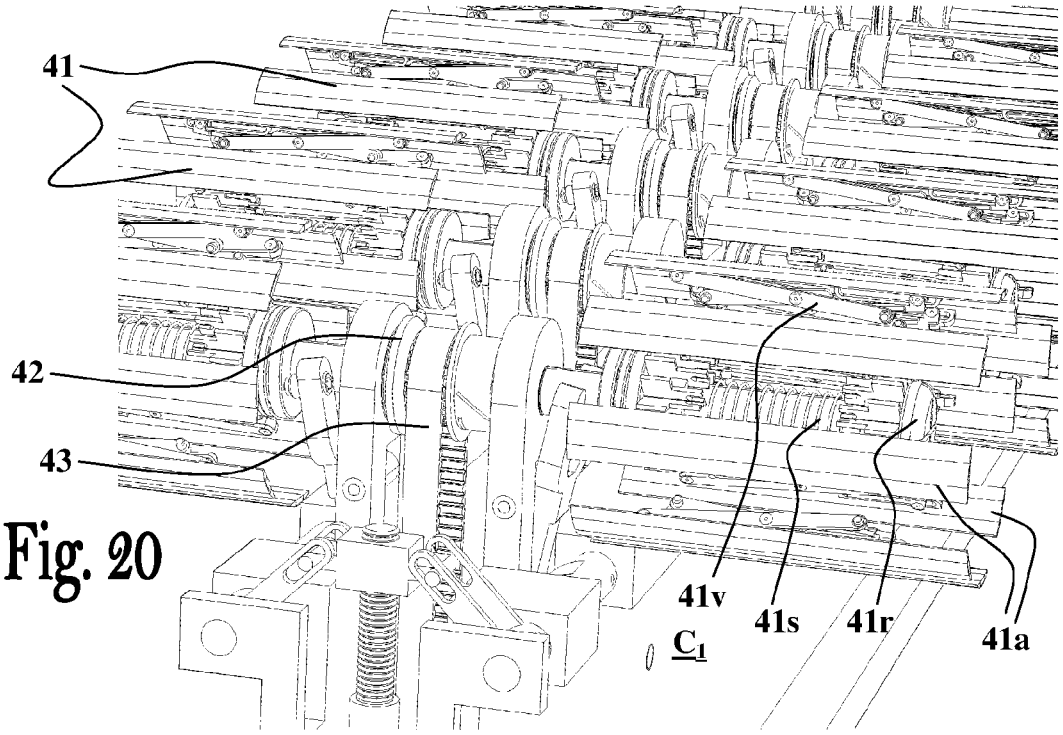
FIG. 20 schematically illustrates a mandrel arrangement according to some possible embodiments.

FIG. 20 provides a closer view of the mandrel arrangement provided in the carriages $C_i$. In some embodiments the mandrels 33 are configured to enable the system to adjust the diameter of the mandrel in order to permit firm attachment to objects 101 having different diameters and lengths (i.e., using a single mandrel type and without requiring mandrel replacement as commonly used in the industry). For this purpose each mandrel 33 may be constructed from a plurality of elongated surfaces 41*a*, where the elongated surfaces 41*a* of each mandrel 33 are connected to a levering mechanism 41*v* configured to affect radial movement of the elongated surfaces 41*a* relative to the axis of rotation of the mandrel 33. The levering mechanism 41*v* may employ a tension spring 41*s* configured to facilitate controllable adjustment of a length of a central shaft 41*r* of the mandrel 33, such that elongation or shortening of the length of the central shaft 41*r* cause respective inward (i.e., increase of mandrel diameter) or outward (i.e., decrease of mandrel diameter) radial movement of the elongated surfaces 41*a* of the mandrel 33. For example, and without being limiting, adjusting external diameter of a 25 mm mandrel to fit into an object 101 having an inner diameter diameters of 50 mm. This type of adjustment is required when different batches of objects 101 are introduced into the printing system (e.g., from a production line) and the setup time required to change the mandrels over the line is affecting the production efficiency. Accordingly, production efficiency can be significantly improved by using the adjustable mandrel setup on the present invention since the dimensions/size of the all mandrels are digitally controlled by the control unit to fit into objects of different sizes/dimensions).

In some embodiments the lengths of the mandrels 33 may be also controllably adjusted according to the geometrical dimensions of the objects 101. For example, and without being limiting, each mandrel 33 may be configured to be inflated by preload pressure applied thereto, and stopped whenever reaching the length of the mandrel 33 i.e., when central shaft 41*r* elongation reaches the length of the inner space of the object 101. The mandrel elongation mechanism may be deflated by applying pressure higher than the preload for load/unload purpose. Accordingly, each carriage may be configured to controllably inflate/deflate 20 mandrels 33 using a single unit activated by pressure. However, mandrel length adjustment is not necessarily required because digital printing typically does not require full contact with the surface of the object 101 being printed. Accordingly, providing mechanical support by the mandrels 33 over a partial length of the objects 101 will be sufficient in most cases.

Figure 21A:
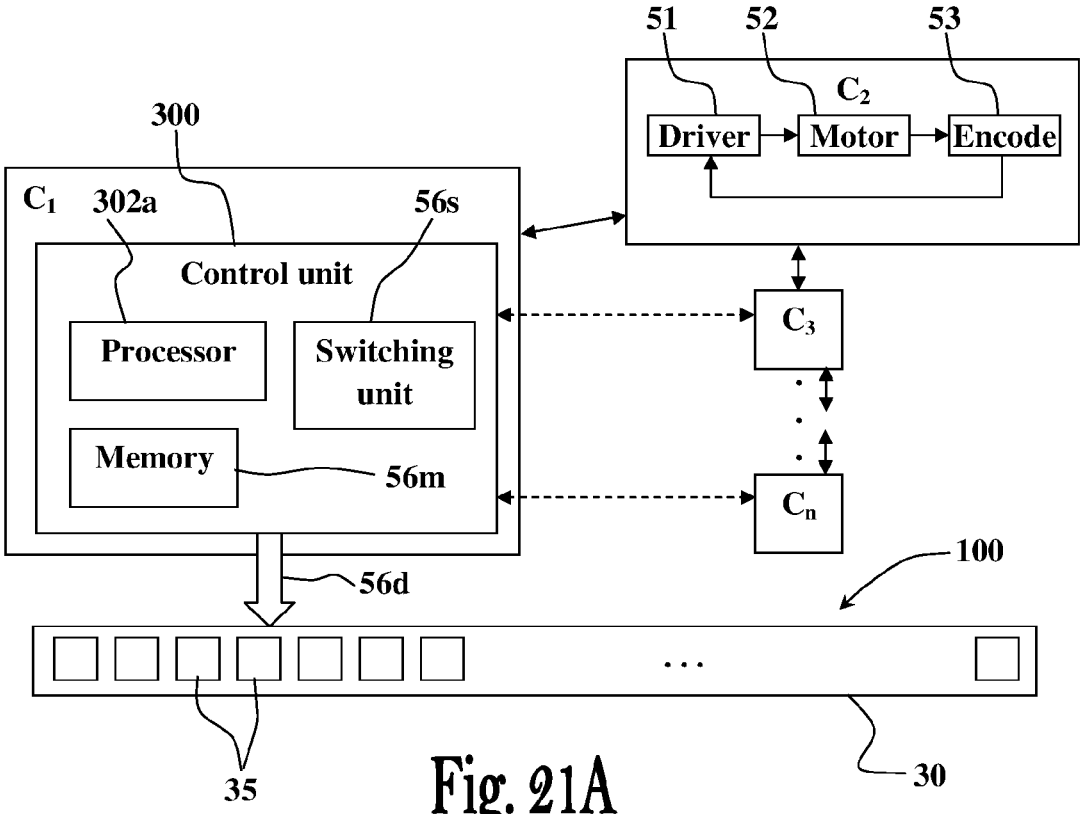
FIGS. 21A to 21C schematically illustrate possible control schemes usable in some possible embodiments.
Figure 21B:
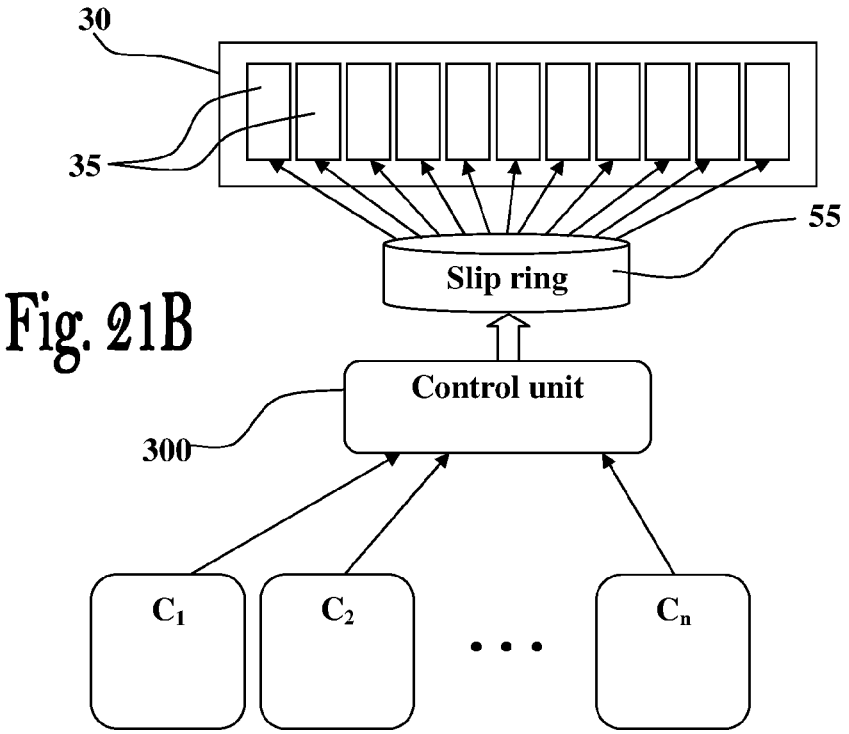
Figure 21C:
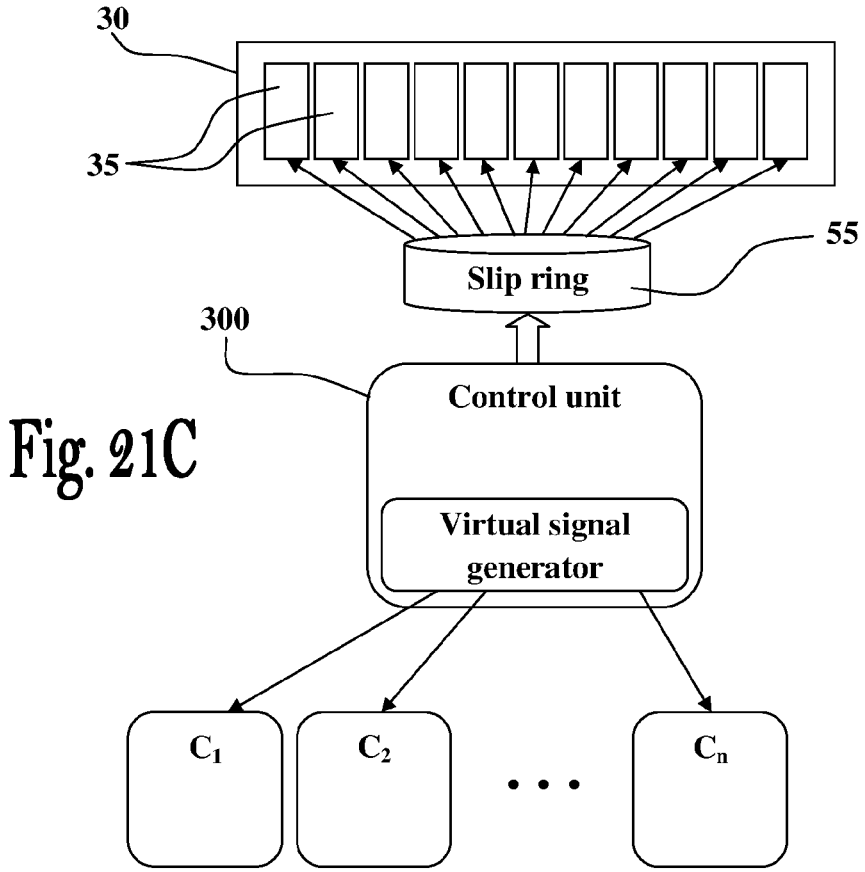

FIGS. 21A to 21C demonstrate possible control schemes that can be used in the printing system 17. One of the tasks of the control unit 300 is to synchronize print heads data jetting signals from each mandrel under the print heads assembly 100 (exemplified in FIG. 21B) or adjust the speed of the carriage to align it with strict control done by the controller/driver on each carriage Ci, so as to adjust a virtual signal for all print heads units and carriages movement or/and rotation (demonstrated in FIG. 21C). For this purpose the control unit 300 is configured to synchronize the ink jetting data supplied to the print heads according to the position of each carriage $C_i$ in the printing zone 12*z*, while simultaneously multiple carriages $C_i$ are being advanced inside the printing zone and their mandrels 33 are being rotated under its printing head arrays. FIG. 21A shows a general control scheme usable in the printing system 17, wherein the control unit 300 is configured to communicate with each one of the carriages $C_i$ to receive its carriage position data and mandrel angular position (orientation, i.e., using rotation encoder) data, and generate the ink jetting data 56*d* supplied to the print head assembly 100 to operate each one of the printing heads 35 having objects 101 located under its nozzles.

FIG. 21A demonstrates possible approaches for communication between the control unit 300 and the carriages $C_i$. One possible approach is to establish serial connection between the plurality of carriages $C_i$ moving on lane 10 e.g., using a flexible cable (not shown) to electrically (and pneumatically) connect each pair of consecutive carriages $C_i$ on the lane 10. In this approach the carriage/mandrel the electrical supply, position data, and other motion and control data are serially transferred along the serial connection of the carriages $C_i$. The data communication over such serial communication connectivity may be performed, for example, using any suitable serial communication protocol (e.g., Ethercat, Etheret and suchlike). In possible embodiments, electrical connection between the carriage $C_i$ and the control unit 300 may be established using an electrical slip ring and/or wirelessly (e.g., Bluetooth, IR, RF, and the like for the data communication and/or a wireless power supply scheme such as inductive charging).

An alternative approach may be to establish direct connection, also called star connection (illustrated by broken arrowed lines) between the control unit 300 and power supply (not shown) units and the carriages $C_i$ on the lane 10. Such direct connection with the carriages $C_i$ may be established using an electrical slip ring and/or wirelessly (e.g., Bluetooth, IR, RF, and the like for the data communication and/or a wireless power supply scheme such as inductive charging).

A switching unit 56*s* may be use in the control unit 300 for carrying out the printing signals switching (index and encoder signals and other signals) of each carriage $C_i$ to the respective print head units 35 above the carriages $C_i$ traversing the printing zone 12*z*. The switching unit 56*s* may be configured to receive all printing signals from all the carriages $C_i$ and switch each one of the received printing signals based on the position of carriages $C_i$ with respect to the relevant print heads 35.

FIG. 21A also demonstrates a possible implementation wherein the control unit 300 is placed on one of the carriages $C_i$; in this non-limiting example on the first carriage $C_1$. Each carriage $C_i$ may also include a controller (not shown) configured to control the speed of the carriage over the lane 10, the rotation of the mandrels 33, the data communication with the control unit 300, and performing other tasks and functionalities of the carriage as required during the different stations (e.g., priming, curing, inspection, loading etc.) along the lane 10. FIG. 21A further shows an exemplary control scheme usable in each carriage $C_i$ for controlling the speed of the carriage. In this control scheme a driver unit 51 is used to operate an electric motor 52 according to speed control data received from the control unit 300, and an encoder 53 coupled to the motor, and/or to rotating element associated with it, is used to acquire data indicative of the current speed/position of the carriage $C_i$ and feeding it back to the driver unit, to thereby establish a closed loop local control.

The control unit 300 may be configured to implement independent control of the carriage $C_i$ typically requires monitoring and managing carriage movement and mandrel rotation speeds, and optionally also full stop thereof, at different stages of the printing process carried out over the elliptic lane 10 (e.g., plasma treatment, UV, inspection, printing, loading/unloading). For example, and without being limiting, the control unit 300 may be configured to perform loading/unloading of a plurality of objects 101 on mandrels 33 of one carriage, simultaneously advance another carriage in high speed through the printing zone 12*z* while printing desired patterns over outer surfaces of a plurality of objects 101 carried by the carriage, and concurrently advance and slowly rotate mandrels of yet another carriage under a UV curing process. The control unit 300 is further configured to guarantee high precision of the carriage movement and mandrel rotation of the carriages $C_i$ traversing the printing zone 12*z* e.g., to maintain advance accuracy of about 5 microns for high print resolution of about 1200 dpi In some possible embodiments each wagon is equipped with two driver units 51, two motors 52 (i.e., a linear carriage movement motor and a mandrel rotative motor), and one or more high resolution position encoders 53 (i.e., a linear encoder and a rotative encoder) which are configured to operate as an independent real time motion system. Each one of the drivers is configured to perform the linear or rotary axis movement, where the carriage linear advance and mandrels rotation per carriage (or per mandrel in other models) according to a general control scheme that is optimized to achieve high precision in real time. Accordingly, each carriage can effect both linear and rotatary motion of the objects, FIGS. 21B and 21C are block diagrams schematically illustrating possible control schemes usable for to achieve synchronization between the carriages Ci and the print head units 35 of the print head assembly 100. FIG. 21B demonstrates a multiple signal synchronization approach, wherein position (linear of the carriage and/or angular of the mandrels) data from each carriage $C_i$ is received and processed by the control unit 300. The control unit 300 process position data, accurately determines which carriage $C_i$ is located under each print head unit 35, and accordingly generates control signals for activation of the print head units 35. The control signals are delivered to the print head assembly 100 through an electrical slip ring mechanism 55 (or any other suitable rotative cable guide). In this configuration each carriage $C_i$ is independently controlled with respect to its speed and position on the lane 10.

FIG. 21B demonstrates another approach employing a single virtual synchronization signal that synchronizes mandrel rotations, speed and position, of all carriage $C_i$ with the print head units 35 of the print head assembly 100. In this embodiment the control unit 300 is configured to provide a virtual pulse to the carriages $C_i$ that receives the virtual pulse and are then accordingly aligned. Once aligned with the virtual pulse, synchronization between the rotation requested and required is achieved. Under such synchronization the controller may use the virtual signal to initiate the print heads units ejection and printing.

In a possible embodiment the electrical slip ring mechanism 55 is installed at the middle of the elliptic lane 10, and the carriages $C_i$ are electrically linked to the print head assembly via flexible cables (that are in between the carriages) electrically coupled to the electrical slip ring mechanism 55. The electrical slip ring mechanism 55 may be configured to transfer the signals from the carriages $C_i$ to the switching unit 56*s* of the control unit 300, which generates control signals to operate the printing heads 35 for printing on the objects held by the respective carriages $C_i$ traversing the printing zone 12*z*. In other possible scenarios the carriages $C_i$ in the printing zone 12*z* are synchronized to one virtual pulse to create a synchronized fire pulse to the print head units 35 and thereby allow single print head printing on a plurality of different tubes carried by different carriages $C_i$ at the same time.

With this design the printing system is capable of maintaining high efficiency of printing heads utilization in cases wherein the length of the objects 101 is greater than the length of a print head, and maintain high printing efficiency in cases wherein a single print head is printing simultaneously on two different objects 101. The print heads 35 may be organized to form a 3D printing tunnel shape.

Printing systems implementation based on the techniques described herein may be designed to reach high throughputs ranging, for example, and without being limiting, between 5,000 to 50,000 objects per hour. In some embodiments the ability to simultaneously print on a plurality of objects traversing the printing zone by the print head assembly may yield utilization of over 80% (efficiency) of the printing heads.

Functions of the printing system described hereinabove may be controlled through instructions executed by a computer-based control system. A control system suitable for use with embodiments described hereinabove may include, for example, one or more processors 302*a* connected to a communication bus, one or more volatile memories 56*m* (e.g., random access memory—RAM) or non-volatile memories (e.g., Flash memory). A secondary memory (e.g., a hard disk drive, a removable storage drive, and/or removable memory chip such as an EPROM, PROM or Flash memory) may be used for storing data, computer programs or other instructions, to be loaded into the computer system.

For example, computer programs (e.g., computer control logic) may be loaded from the secondary memory into a main memory for execution by one or more processors of the control system. Alternatively or additionally, computer programs may be received via a communication interface. Such computer programs, when executed, enable the computer system to perform certain features of the present invention as discussed herein. In particular, the computer programs, when executed, enable a control processor to perform and/or cause the performance of features of the present invention. Accordingly, such computer programs may implement controllers of the computer system.

As described hereinabove and shown in the associated Figs., the present invention provides a printing system for simultaneous printing on a plurality of objects successively streamed through a printing zone, and related methods. While particular embodiments of the invention have been described, it will be understood, however, that the invention is not limited thereto, since modifications may be made by those skilled in the art, particularly in light of the foregoing teachings. As will be appreciated by the skilled person, the invention can be carried out in a great variety of ways, employing more than one technique from those described above, all without exceeding the scope of the invention.

The invention claimed is:

1. A printing system for printing on outer surfaces of objects, the system comprising:

one or more print head assemblies, the print head assembly comprising a matrix of print head units arranged in two or more parallel columns, each column of print head units comprising at least one array of print head units configured to define respective printing route along a printing axis, said at least one array of print head units being arranged along said printing route, each of the print head units having at least one printing element for printing onto respective portions of the objects successively aligned with said at least one printing element while moving with respect to the print head assembly; and a conveyor system configured for simultaneously moving at least two streams of objects along a general conveying direction through at least two of the printing routes, the conveyor system comprising one or more support platforms for supporting the at least two streams of objects each support platform being configured for movement on the conveyor system for moving the objects along the general conveying direction passing through the at least two printing routes and being configured to effect rotation of the objects about their respective printing axes while moving along the printing routes.

2. The system of claim 1, wherein at least two of the print head units in each one of the at least two arrays are spaced-apart along an axis traverse to the printing axis.

3. The system of claim 1, wherein the print head units of the matrix are arranged in a common plane.

4. The system of claim 1, comprising a control unit configured and operable to operate the conveyor system to carry out movement along the general conveying direction along the printing routes, and to operate at least some of the print head units to concurrently print on the objects of said at least two streams of objects.

5. The system of claim 1, comprising a control unit configured and operable to operate the conveyor system to carry out a translational movement along the general conveying direction along the at least two printing routes, to operate at least some of the print head units to concurrently print on the objects of said at least two streams of objects, and to operate at least one of the support platforms to carry out a rotational movement of the objects carried thereon.

6. The system of claim 5, wherein the control unit is configured and operable to operate the conveyor system to carry out the movement along said general conveying direction in a step-like fashion, to operate at least one of the support platforms to carry out the rotational movement during the movement of the said support platforms along the at least two printing routes, and to operate at least some of the print head units to carry out the printing between the step movements of said at least one of the support platforms while the objects carried thereon are being rotated.

7. The system of claim 5, wherein the control unit is configured and operable for operating the conveyor system and at least one of the support platforms to carry out the translational and rotational movements simultaneously while operating at least some of the print head units to effect printing, such that substantially continuous printing of image data is performed on the surfaces of the objects in the streams of objects along a spiral path.

8. The system of claim 1, comprising a control unit configured and operable to operate the conveyor system to carry out a movement along the general conveying direction along the at least two printing routes, and to operate at least some of the print head units to concurrently print on the objects of said at least two streams of objects, wherein the control unit is configured and operable to operate the conveyor system and at least some of the print head units, so as to effect simultaneous printing of image data on surfaces of the objects by at least two print head units belonging to same array of print head units.

9. The system of claim 4, wherein the control unit is configured and operable to effect a change in a distance between at least one print head unit and the object surface aligned with said at least one print head unit to thereby adjust its position.

10. The system of claim 1, wherein the print head units are mounted for movement along radial axes or one or more axes substantially perpendicular to the printing axis.

11. The system of claim 4, wherein the control unit is configured and operable to generate signals for synchronizing operation of the printing elements according to at least one of angular and linear position of the objects carried by at least one of the support platforms along the printing routes.

12. The system of claim 1, comprising at least one curing unit located downstream of the print head assembly and configured for curing a material composition ejected by the print head assembly on the surfaces of the objects.

13. The system of claim 1 comprising at least one priming unit configured for priming at least one location of the surfaces of the objects to receive a composition to be ejected by print head units of said print assembly.

14. The system of claim 1, wherein successive printing elements of at least one of the print head units are configured for ejecting respective compositions on a region of the objects' surfaces, such that at least part of the combination of the respective compositions on the object's surface forms a desired composition.

15. The system of claim 14, wherein the combination of the respective compositions comprises at least one of a mixing between the respective compositions and a chemical reaction between the respective compositions.

16. A method of printing on outer surfaces of objects, the method comprising:

simultaneously moving at least two streams of objects on a support platform through a printing zone comprising a matrix of print head units arranged in two or more parallel columns configured to define respectively at least two parallel printing routes, each printing route comprising at least one array of print head units arranged along a respective printing axis thereof, and rotating said objects about the respective printing axis while moving said support platform along the printing routes;

receiving data indicative of locations of said at least two streams of objects passing through said at least two printing routes and of angular orientation of each object in said streams;

determining, based on the received data, surface areas of said objects facing the print head units of said arrays of print head units, and one or more printing patterns to be applied on said surface areas by the respective print head units; and operating said print head units to apply said one or more patterns on said surface areas by the respective print head units.

17. The method of claim 16, comprising advancing the at least one support platform along the at least two printing routes in discrete steps and rotating the objects during the application of the one or more patterns.

18. The method of claim 16, comprising applying a pre-treatment process to surface areas of the at least two streams of objects.

19. The method of claim 16, comprising applying a curing process to surface areas of the at least two streams of objects.

20. The method of claim 16, comprising generating a signal for synchronizing operation of the print head units according to angular and linear positions of the objects progressing through the at least two printing routes.

21. The method of claim 16, comprising receiving signals indicative of the angular and linear positions of the objects and generating synchronizing signals for operating the printing elements accordingly.

22. The method of claim 16, comprising effecting simultaneous printing of image data on surface area of at least one of the objects by two or more print head units.

23. The method of claim 16, comprising effecting simultaneous printing on surface areas of two different objects by a single print head unit.

24. The method of claim 16, comprising minimizing gaps between adjacently located objects carried by adjacent support platforms.

25. The system of claim 4, wherein the control unit is configured and operable to receive signals indicative of the angular and linear positions of the objects and generate synchronizing signals for operating the printing elements accordingly.

26. A printing system for printing on outer surfaces of objects, the system comprising:

one or more print head assemblies, the print head assembly comprising a matrix of print head units arranged in two or more parallel columns, each column of print head units comprising at least one array of print head units configured to define a printing route along a printing axis, said print head units being arranged in a spaced apart relationship along at least two of the printing routes, each of the print head units having at least one printing element for printing onto respective portions of the objects successively aligned with said at least one printing element while being rotated about said printing axis; and a conveyor system comprising a lane, said at least two printing routes extending along a section of said lane, and at least one support platform, each support platform movably mounted on said lane and configured to support at least two streams of objects respectively, to simultaneously move said at least two streams of objects in a stepwise manner along a general conveying direction through said at least two printing routes, respectively, and effect rotation of the objects about the printing axis during the printing.

27. The method of claim 16 comprising simultaneously advancing the at least one support platform along the at least two printing routes and rotating the objects during the application of the one or more patterns, such that substantially continuous printing of image data is performed on the surfaces of the objects in the streams of objects along a spiral path.

28. The system of claim 1, wherein the conveyor is configured for enabling relative motion between at least one of the objects and the print head assembly along one or more radial axes substantially perpendicular to the axis of translation.

* * * * *